US011847977B2

(12) United States Patent
Hong et al.

(10) Patent No.: US 11,847,977 B2
(45) Date of Patent: Dec. 19, 2023

(54) DISPLAY DEVICE HAVING A REFERENCE VOLTAGE FOR OUTPUTTING TO A SUBPIXEL

(71) Applicant: LG DISPLAY CO., LTD., Seoul (KR)

(72) Inventors: MooKyoung Hong, Gyeonggi-do (KR); Kwangmo Park, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/874,585

(22) Filed: Jul. 27, 2022

(65) Prior Publication Data

US 2023/0043207 A1 Feb. 9, 2023

(30) Foreign Application Priority Data

Aug. 3, 2021 (KR) ..... 10-2021-0101848

(51) Int. Cl.
*G09G 3/3291* (2016.01)

(52) U.S. Cl.
CPC ..... *G09G 3/3291* (2013.01); *G09G 2300/0828* (2013.01); *G09G 2320/0233* (2013.01)

(58) Field of Classification Search
CPC ..... G09G 3/3291
USPC ..... 345/204
See application file for complete search history.

(56) References Cited

U.S. PATENT DOCUMENTS

2015/0001504 A1 1/2015 Kim et al.
2020/0043421 A1* 2/2020 Kang ..... G09G 3/3266
2021/0183299 A1* 6/2021 Park ..... G09G 3/3225
2021/0201816 A1 7/2021 Kim et al.

FOREIGN PATENT DOCUMENTS

KR 2016-0053143 A 5/2016

OTHER PUBLICATIONS

Extended European Search Report in Application No. 22187103.1, dated Dec. 20, 2022, 9 pages.

* cited by examiner

*Primary Examiner* — Long D Pham
(74) *Attorney, Agent, or Firm* — Morgan, Lewis & Bockius LLP

(57) ABSTRACT

A display device may include a display panel and a driver circuit. The display panel may include subpixels, data lines, and reference voltage lines. The driver circuit may drive the data lines. A first subpixel may be connected to a first data line and a first reference voltage line. A driving time of the first subpixel may include a first initialization time in which a reference voltage is applied to the first reference voltage line and a first tracking time in which a voltage of the first reference voltage line increases from the reference voltage. During the first tracking time, a first data signal transferred to the first subpixel through the first data line may be changed from a first voltage value to a reference driving voltage value. The first voltage value may be higher than the reference driving voltage value. The display device may reduce a sensing time.

16 Claims, 23 Drawing Sheets

DISPLAY DEVICE HAVING A REFERENCE VOLTAGE FOR OUTPUTTING TO A SUBPIXEL

CROSS REFERENCE TO RELATED APPLICATION

This application claims the benefit of and priority to Korean Patent Application No. 10-2021-0101848, filed on Aug. 3, 2021, the entirety of which is incorporated herein by reference for all purposes as if fully set forth herein.

BACKGROUND

1. Technical Field

The present disclosure relates to devices and circuits and particularly to, for example, without limitation, a display device and a driver circuit.

2. Discussion of the Related Art

Among display devices currently being developed, there is a self-emissive display device including a display panel capable of emitting light by itself. The display panel of such a self-emissive display device may include subpixels each comprised of an emitting device, a driving transistor for driving the emitting device, and the like in order to emit light by itself.

Each of circuit devices, such as driving transistors and emitting devices, disposed in the display panel of the self-emissive display device has unique characteristics. For example, unique characteristics of each driving transistor may include a threshold voltage, mobility, and the like. Unique characteristics of each emitting device may include a threshold voltage and the like.

Circuit devices in each subpixel may degrade over driving time, and thus the unique characteristics thereof may change. Since the subpixels may have different driving times, characteristics of a circuit device in each subpixel may have different degrees of changes from those of a circuit device in another subpixel. Thus, a characteristic deviation may occur among the subpixels over the driving time, thereby resulting in a luminance deviation among the subpixels. The luminance deviation among the subpixels may be a major factor for reducing brightness uniformity of a display device, thereby deteriorating the quality of images.

Accordingly, a variety of compensation methods for compensating for the luminance deviation among the subpixels have been developed. Such compensation methods are required to sense characteristics of circuit devices included in respective subpixels in order to review the luminance deviation among the subpixels. However, sensing characteristics of circuit devices in each of subpixels requires a significant amount of time. Therefore, this creates a considerable problem because the efficiency of the display device with respect to its operation and use is reduced.

The description provided in the discussion of the related art section should not be assumed to be prior art merely because it is mentioned in or associated with that section. The discussion of the related art section may include information that describes one or more aspects of the subject technology.

SUMMARY

In the display field, there have been problems in that sensing driving of subpixels in a display panel requires a long sensing time, and thus the efficiency of the display device with respect to its operation and use may be reduced. In this regard, the inventors of the present disclosure have invented a display device and a driver circuit capable of reducing sensing time without reducing sensing accuracy.

In addition, the inventors of the present disclosure have discovered through extensive research and experiments that the sensing time deviation among the subpixels in the display device may be caused by the size deviation among transistors in the subpixels. The inventors have thus invented a display device and a driver circuit capable of reducing sensing times while reducing the sensing time deviation among the subpixels.

According to one or more example embodiments, provided are a display device and a driver circuit capable of reducing sensing times.

According to one or more example embodiments, provided are a display device and a driver circuit capable of synchronizing sensing times for subpixels having different structural features while maintaining the sensing accuracy for the subpixels by performing sensing driving by the differentiated data overshooting-based data driving.

One or more example embodiments may provide a display device and a driver circuit having a sensing time reducing function applicable even in a double-rate driving environment.

According to one or more example embodiments, a display device may include: a display panel including a plurality of subpixels, a plurality of data lines, and a plurality of reference voltage lines; and a driver circuit having a configuration for driving the plurality of data lines.

The plurality of subpixels may include a first subpixel connected to a first data line among the plurality of data lines and a first reference voltage line among the plurality of reference voltage lines.

The driving time of the first subpixel may include a first initialization time in which a reference voltage is applied to the first reference voltage line and a first tracking time in which a voltage of the first reference voltage line increases from the reference voltage.

During the first tracking time, the first data signal transferred to the first subpixel through the first data line may be changed from a first voltage value to a reference driving voltage value, and the first voltage value may be higher than the reference driving voltage value.

The plurality of subpixels may include a second subpixel connected to a second data line among the plurality of data lines and a second reference voltage line among the plurality of reference voltage lines.

The driving time of the second subpixel may include a second initialization time in which the reference voltage is applied to the second reference voltage line and a second tracking time in which a voltage of the second reference voltage line increases from the reference voltage.

During the second tracking time, a second data signal transferred to the second subpixel through the second data line may maintain the reference driving voltage value.

Alternatively, during the second tracking time, the second data signal transferred to the second subpixel through the second data line may be changed from a second voltage value to the reference driving voltage value. The second voltage value may be higher than the reference driving voltage value and lower than the first voltage value.

Each of the first subpixel and the second subpixel may include an emitting device and a driving transistor supplying current to the emitting device. The size of the driving transistor of the first subpixel may be smaller than the size of the driving transistor of the second subpixel.

According to one or more example embodiments, a driver circuit may include: a first data channel terminal to which a first data line is connected; a data signal provider for outputting a first data signal to the first data channel terminal; and a first sensing channel terminal connected to a first reference voltage line.

The first data line and the first reference voltage line may be connected to a first subpixel.

A driving time of the first subpixel may include a first initialization time in which a reference voltage is applied to the first reference voltage line and a first tracking time in which a voltage of the first reference voltage line increases from the reference voltage.

During the first tracking time, the first data signal transferred to the first subpixel may be changed from a first voltage value to a reference driving voltage value. The first voltage value may be higher than the reference driving voltage value.

The driver circuit may further include: a second data channel terminal to which a second data line is connected; and a second sensing channel terminal connected to a second reference voltage line.

The second data line and the second reference voltage line may be connected to a second subpixel.

The data signal provider may output a second data signal to the second data channel terminal.

A driving time of the second subpixel may include a second initialization time in which the reference voltage is applied to the second reference voltage line and a second tracking time in which a voltage of the second reference voltage line increases from the reference voltage.

During the second tracking time, the second data signal output through the second data channel terminal may maintain the reference driving voltage value.

Alternatively, during the second tracking time, the second data signal output through the second data channel terminal may be changed from a second voltage value to the reference driving voltage value. The second voltage value may be higher than the reference driving voltage value and lower than the first voltage value.

According to one or more example embodiments, the display device and the driver circuit can reduce sensing times by performing the sensing driving by the data overshooting-based data driving.

According to one or more example embodiments, the display device and the driver circuit can synchronize sensing times for subpixels having different structural features while maintaining sensing accuracy for the subpixels by performing the sensing driving by the differentiated data overshooting-based data driving.

According to one or more example embodiments, the display device and the driver circuit may have a sensing time reduction function applicable to a double-rate driving environment.

In addition, other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with embodiments of the disclosure.

It is to be understood that both the foregoing description and the following description of the present disclosure are exemplary and explanatory, and are intended to provide further explanation of the disclosure as claimed.

BRIEF DESCRIPTION OF THE DRAWINGS

The accompanying drawings, which are included to provide a further understanding of the disclosure and are incorporated in and constitute a part of this disclosure, illustrate aspects and embodiments of the disclosure and together with the description serve to explain principles of the disclosure. In the drawings.

Figure 1:
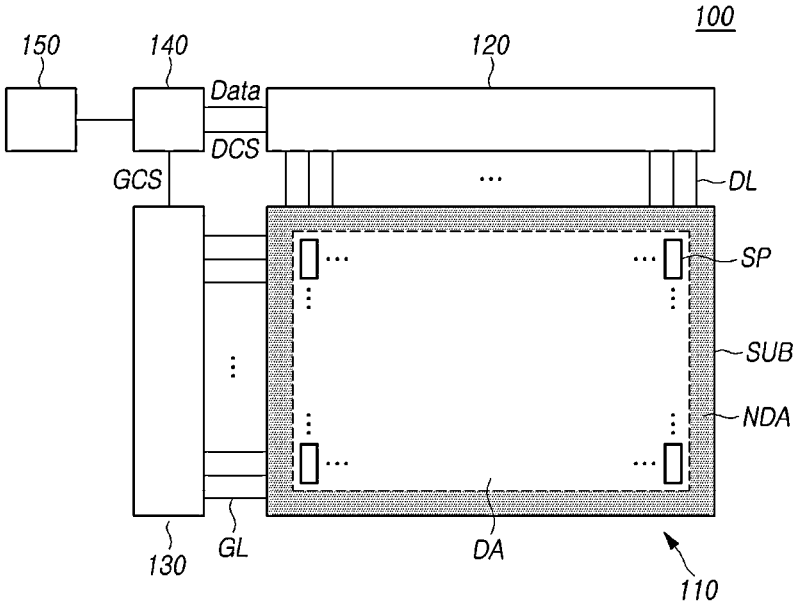
FIG. 1 is a diagram illustrating a system configuration of a display device according to one or more example embodiments.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

In the following description of examples or embodiments of the present invention, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, when a detailed description of well-known functions and components may unnecessarily obscure aspects of the present disclosure, the detailed description thereof may be omitted. The progression of processing steps and/or operations described is an example; however, the sequence of steps and/or operations is not limited to that set forth herein and may be changed as is known in the art, with the exception of steps and/or operations necessarily occurring in a particular order.

Like reference numerals refer to like elements throughout unless stated otherwise. Names of the respective elements used in the following explanations are selected only for convenience of writing the specification and may be thus different from those used in actual products.

Advantages and features of the present disclosure, and implementation methods thereof, will be clarified through following embodiments described with reference to the accompanying drawings. The present disclosure may, however, be embodied in different forms and should not be construed as limited to the embodiments set forth herein. Rather, these embodiments are provided so that this disclosure is thorough and complete and fully conveys the scope of the present disclosure to those skilled in the art. Furthermore, the present disclosure is only defined by claims and their equivalents.

The shapes, sizes, areas, ratios, angles, numbers, and the like disclosed in the drawings for describing embodiments of the present disclosure are merely examples, and thus, the present disclosure is not limited to the illustrated details.

When the term "comprise," "have," "include," "contain," "constitute," "make up of," "formed of," or the like is used, one or more other elements may be added unless a term such as "only" or the like is used. The terms of a singular form may include plural forms unless the context clearly indicates otherwise. The word "exemplary" is used to mean serving as an example or illustration. Any implementation described herein as an "example" is not necessarily to be construed as preferred or advantageous over other implementations.

Terms such as "first," "second," "A," "B," "(A)," "(B)," or the like may be used herein to describe elements of the present invention. Each of these terms is not used to define the essence, order, sequence, number of elements, or the like, but is used merely to distinguish the corresponding element from one or more other elements. For example, a first element could be a second element, and, similarly, a second element could be a first element, without departing from the scope of the present disclosure.

For the expression that an element or layer is "connected," "coupled," or "adhered" to another element or layer, the element or layer can not only be directly connected, coupled, or adhered to another element or layer, but also be indirectly connected, coupled, or adhered to another element or layer with one or more intervening elements or layers disposed or interposed between the elements or layers, unless otherwise specified.

For the expression that an element or layer "contacts," "overlaps," or the like with another element or layer, the element or layer can not only directly contact, overlap, or the like with another element or layer, but also indirectly contact, overlap, or the like with another element or layer with one or more intervening elements or layers disposed or interposed between the elements or layers, unless otherwise specified.

Where positional relationships are described, for example, where the positional relationship between two parts is described using "on," "over," "under," "above," "below," "beneath," "near," "close to," or "adjacent to," "beside," "next to," or the like, one or more other parts may be located between the two parts unless a more limiting term, such as "immediate(ly)," "direct(ly)," or "close(ly)," is used. For example, when a structure is described as being positioned "on," "over," "under," "above," "below," "beneath," "near," "close to," or "adjacent to," "beside," or "next to" another structure, this description should be construed as including a case in which the structures contact each other as well as a case in which one or more additional structures are disposed or interposed therebetween. Furthermore, the terms "front," "rear," "back," "left," "right," "top," "bottom," "downward," "upward," "upper," "lower," "up," "down," "column," "row," "vertical," "horizontal," and the like refer to an arbitrary frame of reference.

When a time relative term, such as "after," "subsequent to," "next," "before," "prior to," or the like, is used to describe processes or operations of elements or configurations, or flows or steps in operating, processing, manufacturing methods, such term may be used to describe non-consecutive or non-sequential processes or operations unless a term such as "directly," "immediately," or the like is used together.

The term "at least one" should be understood as including any and all combinations of one or more of the associated listed items. For example, the meaning of "at least one of a first item, a second item, and a third item" denotes the combination of items proposed from two or more of the first item, the second item, and the third item as well as only one of the first item, the second item, or the third item.

The expression of a first element, a second elements "and/or" a third element should be understood as one of the first, second and third elements or as any or all combinations of the first, second and third elements. By way of example, A, B and/or C can refer to only A; only B; only C; any or some combination of A, B, and C; or all of A, B, and C.

In addition, when any dimensions, relative sizes, or the like are mentioned, it should be understood that numerical values for elements or features, or corresponding information (e.g., levels, ranges, or the like) include a tolerance or error range that may be caused by various factors (e.g., process factors, internal or external impact, noise, or other factors) even when a relevant description is not specified. Further, the term "may" fully encompasses all the meanings of the term "can."

Features of various embodiments of the present disclosure may be partially or wholly coupled to or combined with each other and may be variously inter-operated, linked or driven together. The embodiments of the present disclosure may be carried out independently from each other or may be carried out together in a co-dependent or related relationship. In one or more aspects, the components of each apparatus according to various embodiments of the present disclosure are operatively coupled and configured.

Hereinafter, a variety of embodiments will be described with reference to the accompanying drawings. Furthermore, for convenience of description, a scale, size and thickness of each of the elements illustrated in the accompanying drawings may differ from an actual scale, size and thickness, and thus, embodiments of the present disclosure are not limited to a scale, size and thickness illustrated in the drawings.

FIG. 1 is a diagram illustrating a system configuration of a display device 100 according to one or more example embodiments.

Referring to FIG. 1, a display driving system of the display device 100 according to one or more example embodiments may include a display panel 110 and a driver circuit driving the display panel 110.

The display panel 110 may include a display area DA on which images are displayed and a non-display area NDA on which images are not displayed. The display panel 110 may include a plurality of subpixels SP disposed on a substrate SUB to display images. For example, the plurality of subpixels SP may be disposed in the display area DA. In some cases, at least one subpixel SP may be disposed in the non-display area NDA. The at least one subpixel SP disposed in the non-display area NDA may be referred to as a dummy subpixel.

The display panel 110 may include a plurality of signal lines disposed on the substrate SUB to drive the plurality of subpixels SP. For example, the plurality of signal lines may include a plurality of data lines DL and a plurality of gate lines GL. The signal lines may further include other signal lines, in addition to the plurality of data lines DL and the plurality of gate lines GL, depending on the structure of the subpixels SP. For example, the other signals lines may include driving voltage lines, reference voltage lines, and the like.

The plurality of data lines DL may intersect the plurality of gate lines GL. Each of the plurality of data lines DL may be arranged to extend in a first direction. Each of the plurality of gate lines GL may be arranged to extend in a second direction. Here, the first direction may be a column direction, whereas the second direction may be a row direction. The column direction and the row direction used herein are relative terms. In an example, the column direction may be a vertical direction, whereas the row direction may be a horizontal direction. In another example, the column direction may be a horizontal direction, whereas the row direction may be a vertical direction.

The driver circuit may include a data driver circuit 120 to drive the plurality of data lines DL and a gate driver circuit 130 to drive the plurality of gate lines GL. The driver circuit may further include a controller 140 to drive the data driver circuit 120 and the gate driver circuit 130.

The data driver circuit 120 may be a circuit to drive the plurality of data lines DL. The data driver circuit 120 may output data signals (which may be referred to as data voltages) corresponding to image signals to the plurality of data lines DL. The gate driver circuit 130 may be a circuit to drive the plurality of gate lines GL. The gate driver circuit 130 may generate gate signals and output the gate signals to the plurality of gate lines GL.

The controller 140 may start scanning at points in time defined for respective frames and control data driving at appropriate times in response to the scanning. The controller 140 may convert image data input from an external source into image data Data having a data signal format readable by the data driver circuit 120, and transfer the image data Data to the data driver circuit 120.

The controller 140 may receive display drive control signals together with the input image data from an external host system 150. For example, the display drive control signals may include a vertical synchronization signal Vsync, a horizontal synchronization signal Hsync, an input data enable signal DE, a clock signal, and the like.

The controller 140 may generate data drive control signals DCS and gate drive control signals GCS on the basis of the display drive control signals input from the host system 150. The controller 140 may control drive operations and drive timing of the data driver circuit 120 by transferring the data drive control signals to the data driver circuit 120. The controller 140 may control drive operations and drive timing of the gate driver circuit 130 by transferring the gate drive control signals GCS to the gate driver circuit 130.

The data driver circuit 120 may include one or more source driver integrated circuits (SDICs). Each of the SDICs may include a shift register, a latch circuit, a digital-to-analog converter (DAC), an output buffer, and the like. In some cases, each of the SDICs may further include an analog-to-digital converter (ADC).

For example, each of the SDICs may be connected to the display panel 110 by a tape-automated bonding (TAB) method, connected to a bonding pad of the display panel 110 by a chip-on-glass (COG) method or a chip on panel (COP) method, or implemented using a chip-on-film (COF) structure connected to the display panel 110.

The gate driver circuit 130 may output a gate signal having a turn-on level voltage or a gate signal having a turn-off level voltage under the control of the controller 140. The gate driver circuit 130 may sequentially drive the plurality of gate lines GL by sequentially transferring the gate signal having a turn-on level voltage to the plurality of gate lines GL.

The gate driver circuit 130 may be connected to the display panel 110 by a TAB method, connected to a bonding pad of the display panel 110 by a COG method or a COP method, or connected to the display panel 110 by a COF method. Alternatively, the gate driver circuit 130 may be formed in the non-display area NDA of the display panel 110 by a gate-in-panel (GIP) method. The gate driver circuit 130 may be disposed on the substrate SUB or connected to the substrate SUB. That is, when the gate driver circuit 130 is a GIP type, the gate driver circuit 130 may be disposed in the non-display area NDA of the substrate SUB. When the gate driver circuit 130 is a COG type, a COF type, or the like, the gate driver circuit 130 may be connected to the substrate SUB.

In addition, at least one driver circuit of the data driver circuit 120 and the gate driver circuit 130 may be disposed in the display area DA. For example, at least one driver circuit of the data driver circuit 120 and the gate driver circuit 130 may be disposed to not overlap the subpixels SP or to overlap some or all of the subpixels SP.

The data driver circuit 120 may be connected to one side (e.g., a top side or a bottom side) of the display panel 110. The data driver circuit 120 may be connected to both sides (e.g., both the top side and the bottom side) of the display panel 110 or connected to two or more sides among four sides of the of the display panel 110, depending on the driving method, the design of the display panel, or the like.

The gate driver circuit 130 may be connected to one side (e.g., a left side or a right side) of the display panel 110. The gate driver circuit 130 may be connected to both sides (e.g., both the left side and the right side) of the display panel 110 or connected to two or more sides among four sides of the of the display panel 110, depending on the driving method, the design of the display panel, or the like.

The controller 140 may be provided as a component separate from the data driver circuit 120 or may be combined with the data driver circuit 120 to form an integrated circuit (IC). The controller 140 may be a timing controller typically used in the display field, may be a control device including a timing controller and able to perform other control functions, may be a control device different from the timing controller, or may be a circuit in a control device. The controller 140 may be implemented as a variety of circuits or electronic components, such as an integrated circuit (IC), a field programmable gate array (FPGA), an application specific integrated circuit (ASIC), a processor, or the like.

The controller 140 may be mounted on a printed circuit board (PCB), a flexible printed circuit (FPC), or the like, and electrically connected to the data driver circuit 120 and the gate driver circuit 130 through the PCB, the FPC, or the like. The controller 140 may transmit signals to or receive signals from the data driver circuit 120 through at least one predetermined interface. Here, for example, the interface may include a low-voltage differential signaling (LVDS) interface, an eValid programmatic interface (EPI), a serial peripheral (SP) interface, and the like.

The display device 100 according to one or more example embodiments may be a self-emissive display device in which the display panel 110 emits light by itself. When the display device 100 according to one or more example embodiments is a self-emissive display device, each of the plurality of subpixels SP may include an emitting device (ED). For example, the display device 100 according to one or more example embodiments may be an organic light-emitting display device in which the emitting device is implemented as an organic light-emitting diode (OLED). In another example, the display device 100 according to one or more example embodiments may be an inorganic light-emitting display device in which the emitting device is implemented as an inorganic light-emitting diode based on an inorganic material. In another example, the display device 100 according to one or more example embodiments may be a quantum dot display device in which the emitting device is implemented as a quantum dot that is a self-emissive semiconductor crystal.

Figure 2:
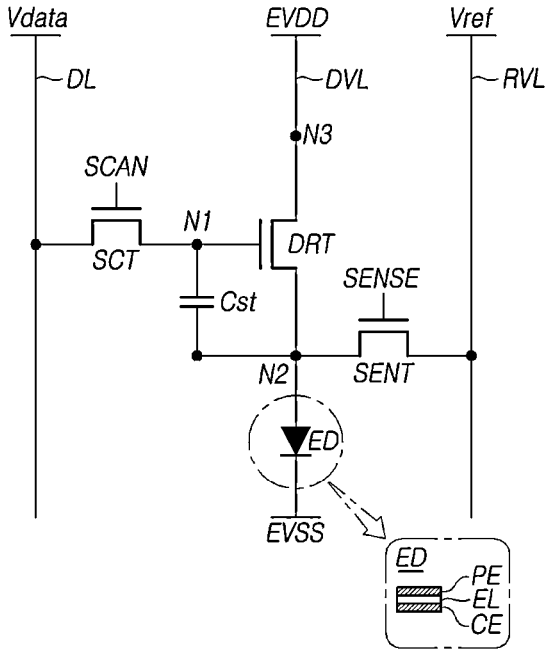
FIG. 2 illustrates an equivalent circuit of a subpixel SP in the display device according to one or more example embodiments.

FIG. 2 illustrates an equivalent circuit of a subpixel SP in the display device 100 according to one or more example embodiments.

Referring to FIG. 2, in the display device 100 according to one or more example embodiments, each of the subpixels SP includes an emitting device ED, a driving transistor DRT supplying a drive current to the emitting device ED to drive the emitting device ED, a scan transistor SCT transferring a data signal Vdata to the driving transistor DRT, a storage capacitor Cst maintaining a voltage for a predetermined period, and the like.

The scan transistor SCT may control the voltage state of a first node N1 of the driving transistor DRT to control the driving state of the subpixel SP. Each subpixel SP may further include a sensing transistor SENT configured to control the voltage state of a second node N2 of the driving transistor DRT in order to control the driving state of the subpixel SP.

The subpixel SP illustrated in FIG. 2 includes three transistors DRT, SCT, and SENT and one capacitor Cst to drive the emitting device ED, and thus may be referred to as having a 3-transistor 1-capacitor (3T1C) structure.

The emitting device ED may include a pixel electrode PE, a common electrode CE, and an emissive layer EL positioned between the pixel electrode PE and the common electrode CE. The pixel electrode PE of the emitting device ED may be an anode or a cathode. The common electrode CE may be a cathode or an anode. A base voltage EVSS corresponding to a common voltage may be applied to the common electrode CE of the emitting device ED. Here, the base voltage EVSS may be, for example, a ground voltage or a voltage similar to the ground voltage. For example, the emitting device ED may be an organic light-emitting diode (OLED), a light-emitting diode (LED) based on an inorganic material, a quantum dot emitting device, or the like.

The driving transistor DRT may be a transistor to drive the emitting device ED, and include the first node N1, the second node N2, and a third node N3. The first node N1 of the driving transistor DRT may be a node corresponding to a gate node, and be electrically connected to a source node or a drain node of the scan transistor SCT. The second node N2 of the driving transistor DRT may be a source node or a drain node, be electrically connected to a source node or a drain node of the sensing transistor SENT, and be electrically connected to the pixel electrode PE of the emitting device ED. The third node N3 of the driving transistor DRT may be a drain node or a source node, and be electrically connected to a driving voltage line DVL through which a driving voltage EVDD is supplied. Hereinafter, for the sake of brevity, the second node N2 of the driving transistor DRT may be described as being a source node, whereas the third node N3 may be described as being a drain node.

The scan transistor SCT may be connected to a data line DL and the first node N1 of the driving transistor DRT. The scan transistor SCT may control the connection between the first node N1 of the driving transistor DRT and a corresponding data line DL among the plurality of data lines DL in response to a scan signal SCAN transferred through a corresponding scan signal line SCL among a plurality of scan signal lines SCL, i.e., a type of gate lines GL.

The drain node or the source node of the scan transistor SCT may be electrically connected to the corresponding data line DL. The source node or the drain node of the scan transistor SCT may be electrically connected to the first node N1 of the driving transistor DRT. The gate node of the scan transistor SCT may be electrically connected to the scan signal line SCL, i.e., a type of gate line GL, to receive the scan signal SCAN applied through the scan signal line SCL.

The scan transistor SCT may be turned on by the scan signal SCAN having a turn-on level voltage to transfer the data signal Vdata transferred through the corresponding data line DL to the first node N1 of the driving transistor DRT. The scan transistor SCT is turned on by the scan signal SCAN having a turn-on level voltage and turned off by the scan signal SCAN having a turn-off level voltage. Here, when the scan transistor SCT is an N-type transistor, the turn-on level voltage may be a high level voltage, and the turn-off level voltage may be a low level voltage. When the scan transistor SCT is a P-type transistor, the turn-on level voltage may be a low level voltage, and the turn-off level voltage may be a high level voltage.

The sensing transistor SENT may be connected to the second node N2 of the driving transistor DRT and a reference voltage line RVL. The sensing transistor SENT may control the connection between the second node N2 of the driving transistor DRT electrically connected to the pixel electrode PE of the emitting device ED and a corresponding reference voltage line RVL among a plurality of reference voltage lines RVL in response to a sensing signal SENSE transferred through a corresponding sensing signal line SENL among a plurality of sensing signal lines SENL, i.e., a type of gate line GL.

The drain node or the source node of the sensing transistor SENT may be electrically connected to the reference voltage line RVL. The source node or the drain node of the sensing transistor SENT may be electrically connected to the second node N2 of the driving transistor DRT, and electrically connected to the pixel electrode PE of the emitting device ED. The gate node of the sensing transistor SENT may be electrically connected to the sensing signal line SENL, i.e., a type of gate line GL, to receive the sensing signal SENSE applied therethrough.

The sensing transistor SENT may be turned on to apply a reference voltage Vref supplied through the reference voltage line RVL to the second node N2 of the driving transistor DRT. The sensing transistor SENT is turned on by the sensing signal SENSE having a turn-on level voltage, and turned off by the sensing signal SENSE having a turn-off level voltage. When the sensing transistor SENT is an N-type transistor, the turn-on level voltage may be a high level voltage, and the turn-off level voltage may be a low level voltage. When the sensing transistor SENT is a P-type transistor, the turn-on level voltage may be a low level voltage, and the turn-off level voltage may be a high level voltage.

The storage capacitor Cst may be electrically connected to the first node N1 and the second node N2 of the driving transistor DRT so as to maintain the data signal Vdata corresponding to an image signal voltage or a voltage corresponding to the data signal Vdata during a one-frame period.

The storage capacitor Cst may be an external capacitor intentionally designed to be provided externally of the driving transistor DRT, rather than a parasitic capacitor (e.g. Cgs or Cgd), i.e., an internal capacitor, present between the gate node and the source node (or the drain node) of the driving transistor DRT.

Each of the driving transistor DRT, the scan transistor SCT, and the sensing transistor SENT may be an N-type transistor or a P-type transistor. All of the driving transistor DRT, the scan transistor SCT, and the sensing transistor SENT may be N-type transistors or P-type transistors. At least one of the driving transistor DRT, the scan transistor SCT, and the sensing transistor SENT may an N-type transistor (or a P-type transistor), and the remaining transistors may be P-type transistors (or N-type transistors).

The scan signal line SCL and the sensing signal line SENL may be different gate lines GL. In this case, the scan signal SCAN and the sensing signal SENSE may be separate gate signals, and the on-off timing of the scan transistor SCT and the on-off timing of the sensing transistor SENT in a single subpixel SP may be independent of each other. That is, the on-off timing of the scan transistor SCT and the on-off timing of the sensing transistor SENT in the single subpixel SP may be the same or different.

Alternatively, the scan signal line SCL and the sensing signal line SENL may be the same gate line GL. That is, the gate node of the scan transistor SCT and the gate node of the sensing transistor SENT in the single subpixel SP may be connected to a single gate line GL. In this case, the scan signal SCAN and the sensing signal SENSE may be the same gate signal, and the on-off timing of the scan transistor SCT and the on-off timing of the sensing transistor SENT in the single subpixel SP may be the same.

The reference voltage line RVL may be disposed for every single subpixel column.

Alternatively, the reference voltage line RVL may be disposed for every two or more subpixel columns. When the reference voltage line RVL is disposed for every two or more subpixel columns, two or more subpixels SP may be supplied with the reference voltage Vref through a single reference voltage line RVL. For example, each reference voltage line RVL may be disposed for every 4 subpixel columns. That is, a single reference voltage line RVL may be shared by subpixels SP in 4 subpixel columns.

The driving voltage line DVL may be disposed for every subpixel column.

Alternatively, the driving voltage line DVL may be disposed for every two or more subpixel columns. When the driving voltage line DVL are disposed for every two or more subpixel columns, two or more subpixels SP may be supplied with the driving voltage EVDD through a single driving voltage line DVL. For example, each driving voltage line DVL may disposed for every 4 subpixel columns. That is, a single driving voltage line DVL may be shared by subpixels SP in 4 subpixel columns.

The 3T1C structure of the subpixel SP illustrated in FIG. 2 is only an example given for explanation. Rather, the subpixel structure may further include one or more transistors, or in some cases, one or more capacitors. In addition, all of the plurality of subpixels may have the same structure, or some of the plurality of subpixels may have a different structure.

In addition, the display device 100 according to one or more example embodiments may have a top emission structure or a bottom emission structure.

In addition, circuit devices, such as the emitting device ED and the driving transistor DRT, included in each of the plurality of subpixels SP may have unique characteristics. For example, each emitting device ED may have unique characteristics, such as a threshold voltage. Each driving transistor DRT may have unique characteristics, such as a threshold voltage and mobility.

The characteristics of the emitting device ED may change with an increase in the driving time of the emitting device ED. The characteristics of the driving transistor DRT may change with an increase in the driving time of the driving transistor DRT.

The plurality of subpixels SP may have different driving times. Thus, changes in the characteristics of the emitting device ED in each of the plurality of subpixels SP may be different from those of the emitting devices ED in other subpixels SP. Thus, a characteristic deviation may occur among the emitting devices ED.

The characteristic deviation among the emitting devices ED or the driving transistors DRT may lead to a luminance deviation among the subpixels SP. Consequently, the luminance uniformity of the display panel 110 may be reduced, thereby degrading the image quality of the display panel 110.

In this regard, the display device 100 according to one or more example embodiments may provide a compensation function to reduce the characteristic deviation among the emitting devices ED or the driving transistors DRT, and may include a compensation circuit for this purpose. Hereinafter, the compensation function and the compensation circuit will be described with reference to FIG. 3.

Figure 3:
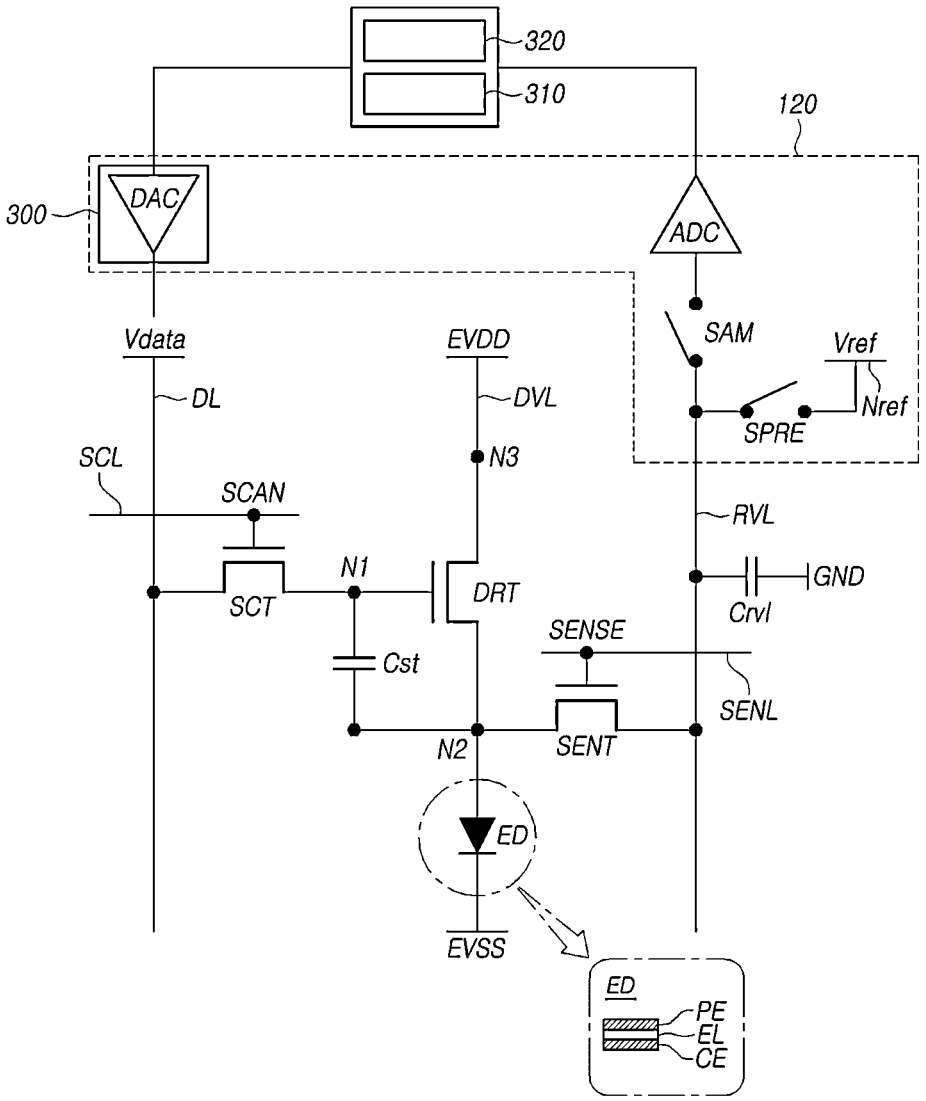
FIG. 3 illustrates a compensation circuit of the display device according to one or more example embodiments.

FIG. 3 illustrates a compensation circuit of the display device 100 according to one or more example embodiments.

The compensation circuit of the display device 100 according to one or more example embodiments is a circuit capable of sensing and compensating for characteristics of circuit devices in each subpixel SP.

Referring to FIG. 3, the compensation circuit may include the subpixel SP, and may also include a power switch SPRE, a sampling switch SAM, an analog-to-digital converter ADC, a compensator 320, and the like to control the operation of the subpixel SP and sense and compensate for characteristics of the subpixel SP (e.g., the threshold voltage of the emitting device ED and the threshold voltage, mobility, and the like of the driving transistor DRT).

The power switch SPRE may control the connection between the reference voltage line RVL and a reference voltage application node Nref. The reference voltage Vref output from the power supply may be supplied to the reference voltage application node Nref, and reference voltage Vref supplied to the reference voltage application node Nref may be applied to the reference voltage line RVL through the power switch SPRE.

The sampling switch SAM may control the connection between the analog-to-digital converter ADC and the reference voltage line RVL. When connected to the reference voltage line RVL by the sampling switch SAM, the analog-to-digital converter ADC may convert a voltage of the connected reference voltage line RVL (corresponding to an analog value) into a sensing value corresponding to a digital value.

A line capacitor Crvl may be formed between the reference voltage line RVL and the ground GND. A voltage of the reference voltage line RVL may correspond to a state of charge of the line capacitor Crvl.

The analog-to-digital converter ADC may provide sensing data including a sensing value to the compensator 320. The compensator 320 may obtain characteristic values of the emitting device ED or the driving transistor DRT of the corresponding subpixel SP on the basis of the sensing data, calculate a compensation value, and store the compensation value in a memory 310.

For example, the compensation value is information for reducing the characteristic deviation among the emitting devices ED or the driving transistors DRT. The compensation value may include offset and gain values for changing data.

The controller 140 may change image data using the compensation value stored in the memory 310, and transfer the changed image data to the data driver circuit 120.

The data driver circuit 120 may include a data signal provider 300 to output data signals to the plurality of data lines DL. The data signal provider 300 may include a latch circuit, a digital-to-analog converter DAC, and the like.

The data signal provider 300 of the data driver circuit 120 may output a data signal Vdata that is an analog value by converting the image data, changed on the basis of the compensation value, into the data signal Vdata using the digital-to-analog converter DAC. Consequently, the compensation may be realized.

Referring to FIG. 3, the analog-to-digital converter ADC, the power switch SPRE, and the sampling switch SAM may be included in the data driver circuit 120. The compensator 320 may be included in the controller 140.

Hereinafter, a sensing driving method will be described in more detail with reference to FIG. 4. The sensing driving method for sensing the threshold voltage of the driving transistor DRT will be described as an example.

Figure 4:
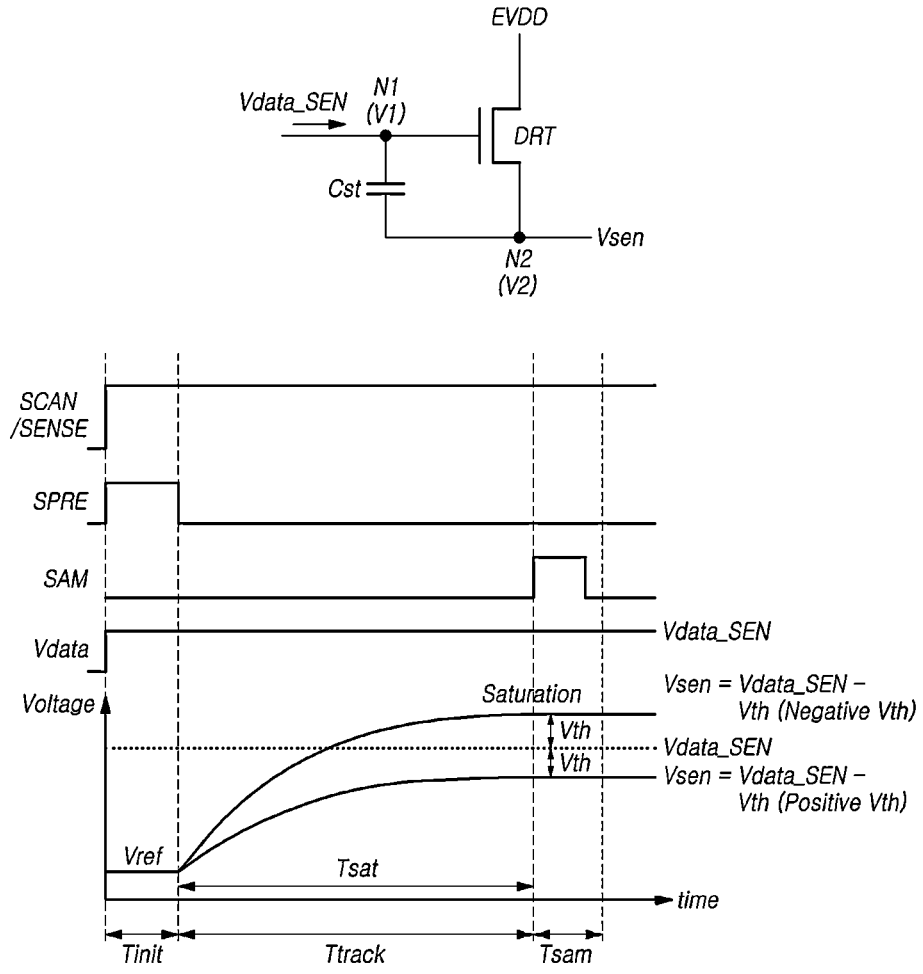
FIG. 4 is a diagram illustrating sensing driving of the display device according to one or more example embodiments.

FIG. 4 is a diagram illustrating the sensing driving of the display device 100 according to one or more example embodiments.

Referring to FIG. 4, a sensing driving time of the display device 100 according to one or more example embodiments may include an initialization time Tinit, a tracking time Ttrack, and a sampling time Tsam.

Referring to FIG. 4, the initialization time Tinit of the sensing driving time is a time period in which the first node N1 and the second node N2 of the driving transistor DRT are initialized. During the initialization time Tinit, a voltage V1 on the first node N1 of the driving transistor DRT may be initialized as a sensing driving data signal Vdata_SEN, and a voltage V2 on the second node N2 of the driving transistor DRT may be initialized as a sensing driving reference voltage Vref. In FIG. 4, the term "Voltage" depicted along the vertical axis may represent the voltage V2 on the second node N2 of the driving transistor DRT.

The sensing driving data signal Vdata_SEN may be a data signal having a specific voltage value for sensing driving, and typically, may have a constant voltage value during a single sensing driving time.

During the initialization time Tinit, the scan transistor SCT and the sensing transistor SENT may be turned on, and the power switch SPRE may be turned on.

Referring to FIG. 4, the tracking time Ttrack of the sensing driving time is a time period in which a threshold voltage Vth of the driving transistor DRT or a voltage V2 on the second node N2 of the driving transistor DRT reflecting a change in the threshold voltage Vth is tracked.

During the tracking time Ttrack, the power switch SPRE may be turned off or the sensing transistor SENT may be turned off. Thus, the second node N2 of the driving transistor DRT may be in a state in which the reference voltage Vref is no longer applied to the second node N2. That is, the second node N2 of the driving transistor DRT may be in an electrically floated state.

In other words, during the tracking time Ttrack, the first node N1 of the driving transistor DRT has no undesired voltage fluctuation, due to the sensing driving data signal Vdata_SEN applied thereto. However, in this state, the second node N2 of the driving transistor DRT may be in an electrically floated state. Thus, during the tracking time Ttrack, the voltage V2 on the second node N2 of the driving transistor DRT may fluctuate.

During the tracking time Ttrack, until the voltage V2 on the second node N2 of the driving transistor DRT reflects the threshold voltage Vth of the driving transistor DRT, the voltage V2 on the second node N2 of the driving transistor DRT may be increased.

During the initialization time Tinit, a voltage difference Vdata_SEN-Vref between the first node N1 and the second node N2 may be equal to or higher than the threshold voltage Vth of the driving transistor DRT (Vdata_SEN−Vref≥Vth). Thus, when the tracking time Ttrack starts, the driving transistor DRT is in a turned-on state and allows a current to flow therethrough. Consequently, when the tracking time Ttrack starts, the voltage V2 on the second node N2 of the driving transistor DRT may start to increase.

During the tracking t ime Ttrack, the voltage V2 on the second node N2 of the driving transistor DRT may increase and, after a predetermined time has passed, be saturated instead of continuing to increase. That is, the incremental changes in the voltage on the second node N2 of the driving transistor DRT may decrease toward the end of the tracking time Ttrack, so that the voltage V2 on the second node N2 of the driving transistor DRT may be saturated.

The saturated voltage V2 on the second node N2 of the driving transistor DRT may correspond to a difference Vdata_SEN−Vth between the data signal Vdata_SEN and the threshold voltage Vth. Here, the threshold voltage Vth may be a negative threshold voltage Negative Vth having a negative value or a positive threshold voltage Positive Vth having a positive value.

When the voltage V2 on the second node N2 of the driving transistor DRT is saturated, the sampling time Tsam may be started. The sampling time Tsam may be started as the sampling switch SAM is turned on.

Referring to FIG. 4, in one or more aspects, the sampling time Tsam of the sensing driving time is a time period in which the threshold voltage Vth of the driving transistor DRT or the voltage Vdata_SEN-Vth or Vdata_SEN−ΔVth reflecting a change in the threshold voltage Vth is measured or obtained.

In one or more aspects, the sampling time Tsam of the sensing driving time is a time period in which the voltage of the reference voltage line RVL to which the analog-to-digital converter ADC is connected through the sampling switch SAM is sensed. Here, the voltage of the reference voltage line RVL may correspond to the voltage on the second node N2 of the driving transistor DRT, and correspond to a charging voltage of the line capacitor Crvl formed on the reference voltage line RVL.

During the sampling time Tsam, the voltage Vsen sensed by the analog-to-digital converter ADC may be the voltage Vdata_SEN-Vth obtained by subtracting the threshold voltage Vth from the data signal Vdata_SEN or the voltage Vdata_SEN−ΔVth obtained by subtracting the threshold voltage deviation AVth from the data signal Vdata_SEN. The threshold voltage Vth may be a positive threshold voltage or a negative threshold voltage.

Referring to FIG. 4, during the tracking time Ttrack of the sensing driving time, a time taken for the voltage V2 on the second node N2 of the driving transistor DRT to be saturated after having been increased may be referred to as a saturation time Tsat. For example, a saturation time Tsat may be a time period between a first time and a second time, where the first time is when the voltage V2 on the second node N2 of the driving transistor DRT starts to increase or rise (from an initial voltage during the initialization time Tinit), and the second time is a time when the voltage V2 on the second node N2 of the driving transistor DRT has reached a saturation point.

The saturation time Tsat may be a time taken for the threshold voltage Vth of the driving transistor DRT or a change thereof to be reflected on the voltage V2=Vdata_SEN-Vth on the second node N2 of the driving transistor DRT.

Thus, in one or more aspects, the time length of the tracking time Ttrack for accurately sensing the threshold voltage Vth should be set to be equal to or shorter than the saturation time Tsat.

The saturation time Tsat may occupy most of the entire time length (which may be referred to as a "sensing time") of the sensing driving time. In one or more aspects, since the saturation time Tsat is significantly increased as described above, the entire sensing time for threshold voltage sensing driving should be significantly increased.

Due to the saturation time Tsat according to the sensing driving method as described above, a sensing time for a single subpixel SP may be increased. The higher the resolution of the display panel 110 and the greater the number of the subpixels SP, the longer the time taken to sense all of the subpixels SP disposed in the display panel 110 may be.

While sensing of the display panel 110 is being performed, a user may not be able to watch the display device. Thus, after the display device 100 is powered off, the sensing driving may be performed when the user is not watching the display device 100.

Figure 5:
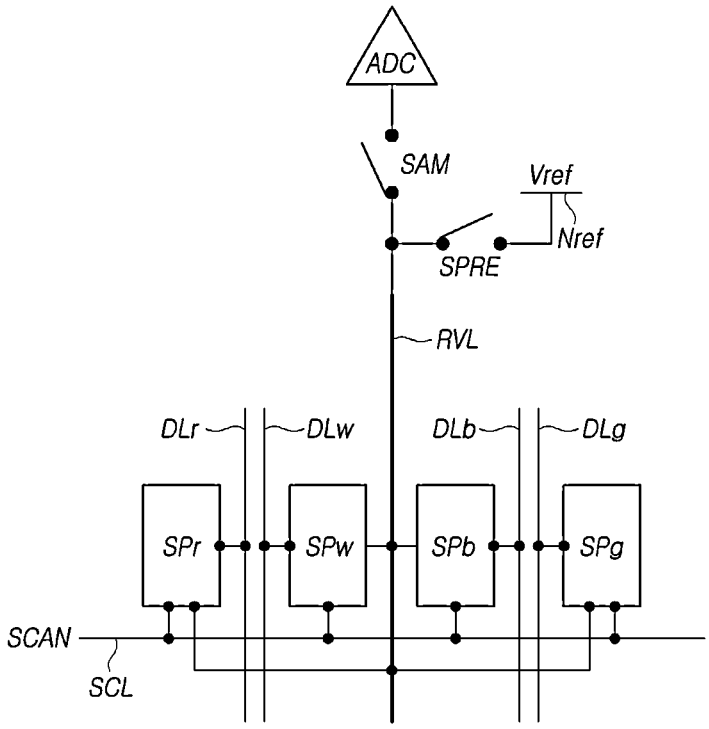
FIG. 5 is a diagram illustrating four subpixels and related signal lines in the display device according to one or more example embodiments.

FIG. 5 is a diagram illustrating four subpixels SPr, SPw, SPb, and SPg and related signal lines DLr, DLw, DLb, DLg, SCL, and RVL in the display device 100 according to one or more example embodiments.

Referring to FIG. 5, for example, a plurality of subpixels SP disposed in the display panel 110 according to one or more example embodiments may include subpixels SPr, SPw, SPb, and SPg emitting 4 colors of light.

For example, the subpixels SPr, SPw, SPb, and SPg emitting 4 colors of light may include red subpixels SPr emitting red light, white subpixels SPw emitting white light, blue subpixels SPb emitting blue light, and green subpixels SPg emitting green light.

The red subpixels SPr may have the same structure or characteristics. The white subpixels SPw may have the same structure or characteristics. The blue subpixels SPb may have the same structure or characteristics. The green subpixels SPg may have the same structure or characteristics.

For example, the structure of the subpixel SP may include at least one among the positions of arrangement of circuit devices (e.g., ED, DRT, SCT, SENT, and Cst), the sizes of the circuit devices (e.g., ED, DRT, SCT, SENT, and Cst), the area of the entire region of the subpixel SP, the area of the emission region of the subpixel SP, the area of the circuit region of the subpixel SP, and the like.

Referring to FIG. 5, as described above, in one or more examples, a single reference voltage line RVL may be disposed for every 4 subpixel columns. For example, a red subpixels SPr, a white subpixel SPw, a blue subpixel SPb, and a green subpixel SPg may share one reference voltage line RVL. That is, the red subpixel SPr, the white subpixel SPw, the blue subpixel SPb, and the green subpixel SPg may be supplied with the reference voltage Vref through a single reference voltage line RVL.

In sensing driving of each of the red subpixel SPr, the white subpixel SPw, the blue subpixel SPb, and the green subpixel SPg, a single reference voltage line RVL may be used.

The drain node or the source node of the sensing transistor SENT of the red subpixel SPr, the drain node or the source node of the sensing transistor SENT of the white subpixel SPw, the drain node or the source node of the sensing transistor SENT of the blue subpixel SPb, and the drain node or the source node of the sensing transistor SENT of the green subpixel SPg may be electrically connected to a single reference voltage line RVL.

The positions of arrangement of the red subpixel SPr, the white subpixel SPw, the blue subpixel SPb, and the green subpixel SPg may be variously designed. For example, when the red subpixel SPr, the white subpixel SPw, the blue subpixel SPb, and the green subpixel SPg are arranged in the order listed, the reference voltage line RVL may be disposed between the white subpixel SPw and the blue subpixel SPb.

The white subpixel SPw and the blue subpixel SPb may be directly connected to the reference voltage line RVL or electrically connected to the reference voltage line RVL through an additional connection pattern. The red subpixel SPr and the green subpixel SPg may be directly connected to the reference voltage line RVL or electrically connected to the reference voltage line RVL through an additional connection pattern.

Referring to FIG. 5, a single power switch SPRE and a single sampling switch SAM may be present for a single reference voltage line RVL.

Referring to FIG. 5, a single analog-to-digital converter ADC may be present for a plurality of reference voltage lines RVL. A sample and hold circuit may be provided between the plurality of sampling switches SAM connected to the plurality of reference voltage lines RVL and the single analog-to-digital converter ADC. Unlike the above, a single analog-to-digital converter ADC may be present for every single reference voltage line RVL. Hereinafter, a situation in which a single analog-to-digital converter ADC is present for a plurality of reference voltage lines RVL will be described as an example.

The red subpixel SPr, the white subpixel SPw, the blue subpixel SPb, and the green subpixel SPg arranged on a single subpixel line may be connected to a single scan signal line SCL. In some cases, the red subpixel SPr, the white subpixel SPw, the blue subpixel SPb, and the green subpixel SPg arranged on a single subpixel line may be connected to a single sensing signal line SENL. Hereinafter, the sensing signal line SENL will be omitted.

Hereinafter, two driving structures and driving methods of the display device 100 according to one or more example embodiments will be described with reference to FIGS. 6 to 9. For the sake of explanation, 8 subpixels SPr1, SPw1, SPb1, SPg1, SPr2, SPw2, SPb2, and SPg2 will be described as being disposed on a single subpixel line as an example.

Figure 6:
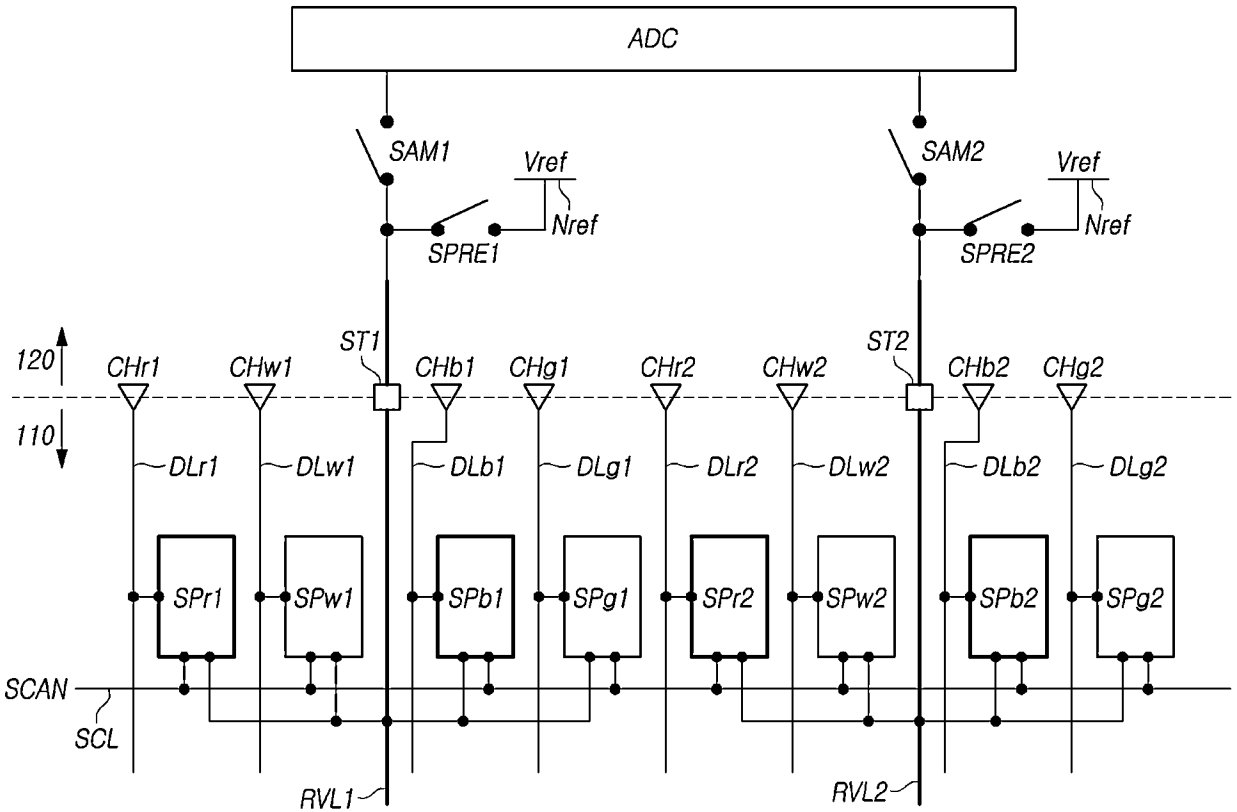
FIG. 6 is a diagram illustrating a structure for a first driving method in the display device according to one or more example embodiments.
Figure 7:
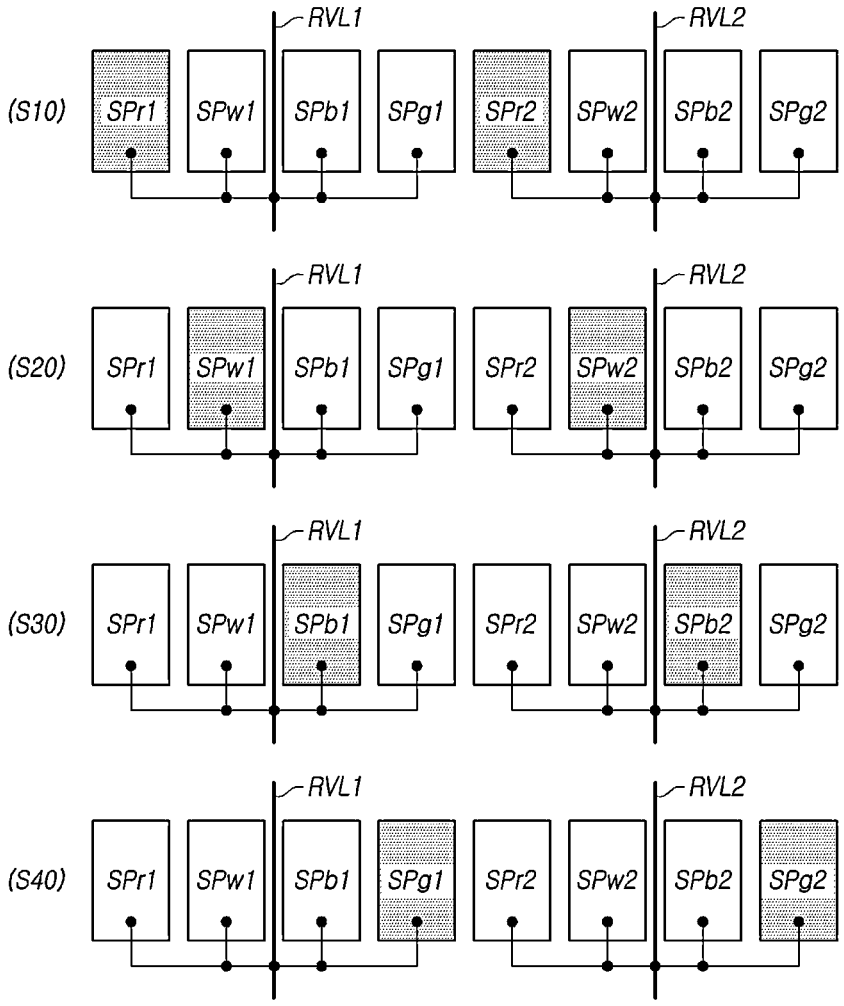
FIG. 7 is a diagram illustrating the order of sensing driving of eight subpixels by the first driving method in the display device according to one or more example embodiments.
Figure 8:
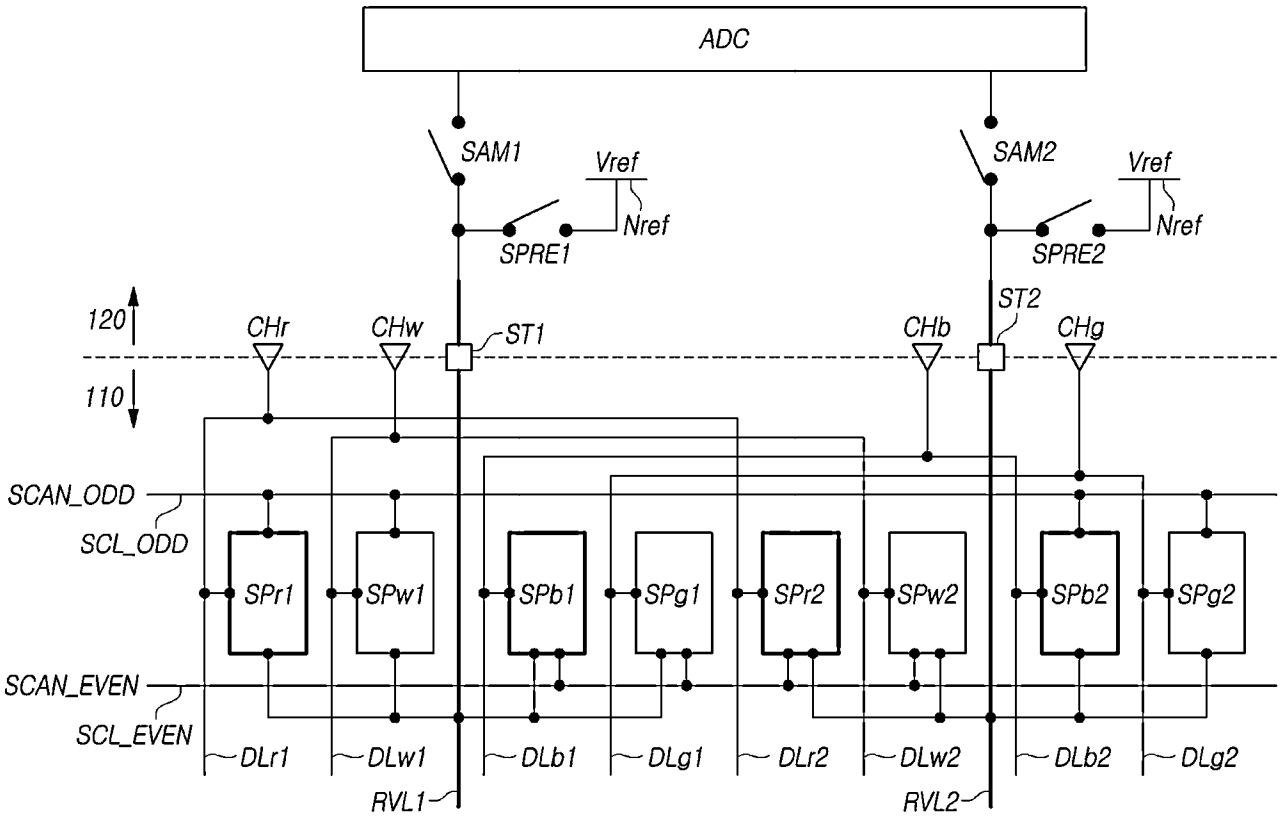
FIG. 8 is a diagram illustrating a structure for a second driving method in the display device according to one or more example embodiments.
Figure 9:
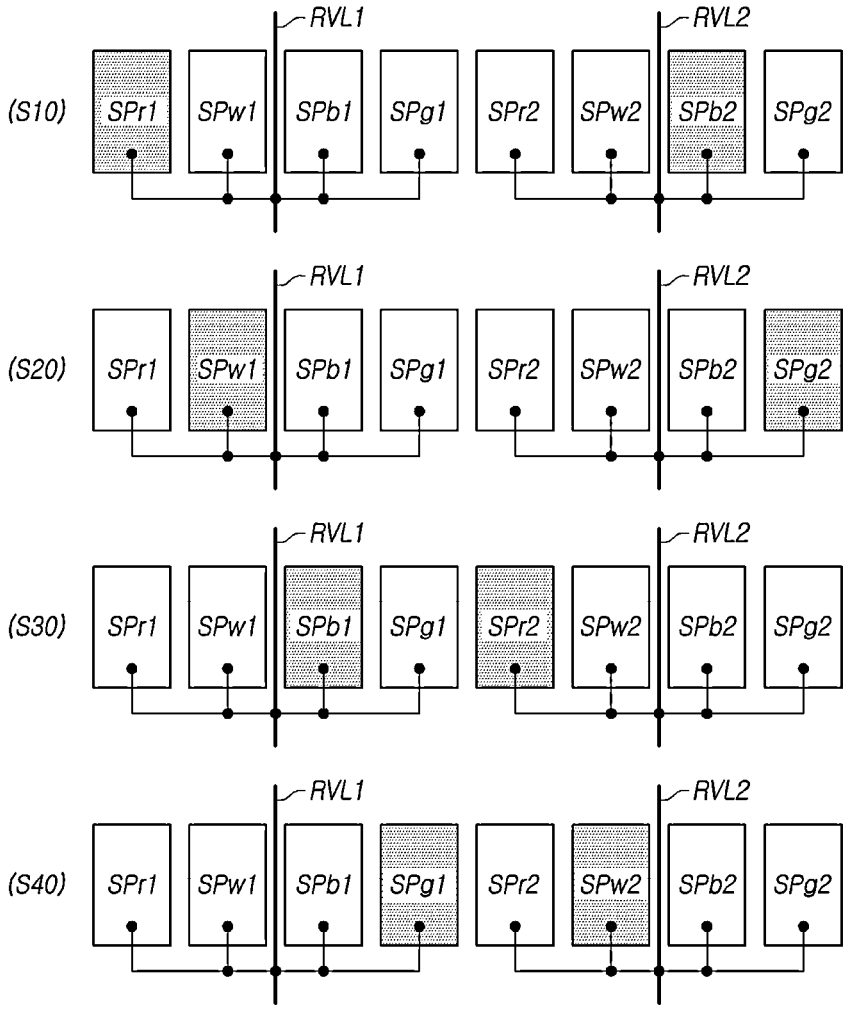
FIG. 9 is a diagram illustrating the order of sensing driving of eight subpixels by the second driving method in the display device according to one or more example embodiments.

FIG. 6 is a diagram illustrating a structure for a first driving method in the display device 100 according to one or more example embodiments. FIG. 7 is a diagram illustrating the order of sensing driving of 8 subpixels by the first driving method in the display device 100 according to one or more example embodiments. FIG. 8 is a diagram illustrating a structure for a second driving method in the display device 100 according to one or more example embodiments. FIG. 9 is a diagram illustrating the order of the sensing driving of 8 subpixels by the second driving method in the display device 100 according to one or more example embodiments.

Referring to FIGS. 6 to 9, the 8 subpixels SPr1, SPw1, SPb1, SPg1, SPr2, SPw2, SPb2, and SPg2 may include a first group of subpixels SPr1, SPw1, SPb1, and SPg1 sharing a first reference voltage line RVL1 and a second group of subpixels SPr2, SPw2, SPb2, and SPg2 sharing a second reference voltage line RVL2.

The first group of subpixels SPr1, SPw1, SPb1, and SPg1 may include a red subpixel SPr1, a white subpixel SPw1, a blue subpixel SPb1, and a green subpixel SPg1. The second group of subpixels SPr2, SPw2, SPb2, and SPg2 may include a red subpixel SPr2, a white subpixel SPw2, a blue subpixel SPb2, and a green subpixel SPg2.

Referring to FIGS. 6 to 9, regarding the first reference voltage line RVL1, a first power switch SPRE1 and a first sampling switch SAM1 may be present. Regarding the second reference voltage line RVL2, a second power switch SPRE2 and a second sampling switch SAM2 may be present.

The electrical connection between the first reference voltage line RVL1 and the reference voltage application node Nref may be switched through the first power switch SPRE1. The electrical connection between the second reference voltage line RVL2 and the reference voltage application node Nref may be switched through the second power switch SPRE2.

The electrical connection between the first reference voltage line RVL1 and the analog-to-digital converter ADC may be switched through the first sampling switch SAM1. The electrical connection between the second reference voltage line RVL2 and the analog-to-digital converter ADC may be switched through the second sampling switch SAM2.

Referring to FIGS. 6 to 9, the first power switch SPRE1, the first sampling switch SAM1, the second power switch SPRE2, and the second sampling switch SAM2 may be included in the data driver circuit 120. In this case, the data driver circuit 120 may include a first sensing channel terminal ST1 to which the first reference voltage line RVL1 is connected and a second sensing channel terminal ST2 to which the second reference voltage line RVL2 is connected.

Referring to FIGS. 6 to 9, the 8 subpixels SPr1, SPw1, SPb1, SPg1, SPr2, SPw2, SPb2, and SPg2 may be connected to 8 data lines DLr1, DLw1, DLb1, DLg1, DLr2, DLw2, DLb2, and DLg2, respectively.

Thus, the 8 subpixels SPr1, SPw1, SPb1, SPg1, SPr2, SPw2, SPb2, and SPg2 may be supplied with data signals through the 8 data lines DLr1, DLw1, DLb1, DLg1, DLr2, DLw2, DLb2, and DLg2, respectively.

The data driver circuit 120 may be connected to the 8 data lines DLr1, DLw1, DLb1, DLg1, DLr2, DLw2, DLb2, and DLg2. The structure by which the data driver circuit 120 is connected to the 8 data lines DLr1, DLw1, DLb1, DLg1, DLr2, DLw2, DLb2, and DLg2 may vary depending on the driving method.

Referring to FIG. 6, according to a structure for the first driving method, the data driver circuit 120 may separately and independently drive the 8 data lines DLr1, DLw1, DLb1, DLg1, DLr2, DLw2, DLb2, and DLg2.

The data driver circuit 120 may supply different data signals through the 8 data lines DLr1, DLw1, DLb1, DLg1, DLr2, DLw2, DLb2, and DLg2. In this regard, the data driver circuit 120 may include 8 data channel terminals CHr1, CHw1, CHb1, CHg1, CHr2, CHw2, CHb2, and CHg2 connected to the 8 data lines DLr1, DLw1, DLb1, DLg1, DLr2, DLw2, DLb2, and DLg2, respectively. The 8 data channel terminals CHr1, CHw1, CHb1, CHg1, CHr2, CHw2, CHb2, and CHg2 may be connected to the data signal provider 300.

Referring to FIG. 8, according to a structure for the second driving method, the data driver circuit 120 may drive the 8 data lines DLr1, DLw1, DLb1, DLg1, DLr2, DLw2, DLb2, and DLg2 by pairing every two data lines thereof.

The data driver circuit 120 may simultaneously drive the data line DLr1 connected to the red subpixel SPr1 included in the first subpixel group and the data line DLr2 connected to the red subpixel SPr2 included in the second subpixel group. In this regard, the data driver circuit 120 may include a single common red data channel terminal CHr to which the data line DLr1 connected to the red subpixel SPr1 included in the first subpixel group and the data line DLr2 connected to the red subpixel SPr2 included in the second subpixel group are connected in common.

When the data driver circuit 120 outputs a data signal through the common red data channel terminal CHr, the data signal may be supplied to both the data line DLr1 connected to the red subpixel SPr1 included in the first subpixel group and the data line DLr2 connected to the red subpixel SPr2 included in the second subpixel group.

The data driver circuit 120 may simultaneously drive the data line DLw1 connected to the white subpixel SPw1 included in the first subpixel group and the data line DLw2 connected to the white subpixel SPw2 included in the second subpixel group.

In this regard, the data driver circuit 120 may include a single common white data channel terminal CHw to which the data line DLw1 connected to the white subpixel SPw1 included in the first subpixel group and the data line DLw2 connected to the white subpixel SPw2 included in the second subpixel group are connected in common.

When the data driver circuit 120 outputs a data signal through the common white data channel terminal CHw, the data signal may be supplied to both the data line DLw1 connected to the white subpixel SPw1 included in the first subpixel group and the data line DLw2 connected to the white subpixel SPw2 included in the second subpixel group.

The data driver circuit 120 may simultaneously drive the data line DLb1 connected to the blue subpixel SPb1 included in the first subpixel group and the data line DLb2 connected to the blue subpixel SPb2 included in the second subpixel group.

In this regard, the data driver circuit 120 may include a single common blue data channel terminal CHb to which the data line DLb1 connected to the blue subpixel SPb1 included in the first subpixel group and the data line DLb2 connected to the blue subpixel SPb2 included in the second subpixel group are connected in common.

When the data driver circuit 120 outputs a data signal to the common blue data channel terminal CHb, the data signal may be supplied to both the data line DLb1 connected to the blue subpixel SPb1 included in the first subpixel group and the data line DLb2 connected to the blue subpixel SPb2 included in the second subpixel group.

The data driver circuit 120 may simultaneously drive the data line DLg1 connected to the green subpixel SPg1 included in the first subpixel group and the data line DLg2 connected to the green subpixel SPg2 included in the second subpixel group.

In this regard, the data driver circuit 120 may include a single common green data channel terminal CHg to which the data line DLg1 connected to the green subpixel SPg1 included in the first subpixel group and the data line DLg2 connected to the green subpixel SPg2 included in the second subpixel group are connected in common.

When the data driver circuit 120 outputs a data signal to the common green data channel terminal CHg, the data signal may be supplied to both the data line DLg1 connected to the green subpixel SPg1 included in the first subpixel group and the data line DLg2 connected to the green subpixel SPg2 included in the second subpixel group.

The common red data channel terminal CHr, the common white data channel terminal CHw, the common blue data channel terminal CHb, and the common green data channel terminal CHg may be connected to the data signal provider 300.

Referring to FIG. 6, according to the structure for the first driving method, a single scan signal line SCL may be disposed for a single subpixel line. That is, the 8 subpixels SPr1, SPw1, SPb1, SPg1, SPr2, SPw2, SPb2, and SPg2 may be connected in common to a single scan signal line SCL.

The 8 subpixels SPr1, SPw1, SPb1, SPg1, SPr2, SPw2, SPb2, and SPg2 may be supplied in common with the scan signal SCAN through a single scan signal line SCL.

Referring to FIG. 8, according to a structure for the second driving method, 2 scan signal lines SCL ODD and SCL EVEN may be disposed for a single subpixel line.

Some of the 8 subpixels SPr1, SPw1, SPb1, SPg1, SPr2, SPw2, SPb2, and SPg2 may be connected to a first scan signal line SCL ODD of two scan signal lines SCL ODD and SCL EVEN, and some others may be connected to a second scan signal line SCL EVEN of the two scan signal lines SCL ODD and SCL EVEN.

For example, the first scan signal line SCL ODD may be connected to the red subpixel SPr1 and the white subpixel SPw1 of the first subpixel group and the blue subpixel SPb2 and the green subpixel SPg2 of the second subpixel group.

The second scan signal line SCL EVEN may be connected to the blue subpixel SPb1 and the green subpixel SPg1 of the first subpixel group and the red subpixel SPr2 and the white subpixel SPw2 of the second subpixel group.

The first driving method described herein may be referred to as a single-rate driving (SRD) method, whereas the second driving method described herein may be referred to as a double-rate driving (DRD) method. According to the second driving method, the number of data channels of the data driver circuit 120 may be reduced by half.

As described above, in one or more aspects, the reference voltage line RVL may serve as a sensing path, and thus the display device 100 may not simultaneously perform the sensing driving of each of subpixels SP connected to a single reference voltage line RVL.

Consequently, the display device 100 may perform the sensing driving of only one of the subpixels SP connected to the single reference voltage line RVL.

Referring to FIGS. 6 to 9, in one or more aspects, the display device 100 may not simultaneously perform the sensing driving of each of the red subpixel SPr1, the white subpixel SPw1, the blue subpixel SPb1, and the green subpixel SPg1 included in the first group of subpixels SPr1, SPw1, SPb1, and SPg1 sharing the first reference voltage line RVL1.

The display device 100 may not simultaneously perform the sensing driving of each of the red subpixel SPr2, the white subpixel SPw2, the blue subpixel SPb2, and the green subpixel SPg2 included in the second group of subpixels SPr2, SPw2, SPb2, and SPg2 sharing the second reference voltage line RVL2.

Referring to FIG. 7, in the sensing driving according to the first driving method, the display device 100 may simultaneously sense the subpixels SP of the same color using the first reference voltage line RVL1 and the second reference voltage line RVL2.

In step S10, the display device 100 may simultaneously perform the sensing driving of the red subpixel SPr1 connected to the first reference voltage line RVL1 and the sensing driving of the red subpixel SPr2 connected to the second reference voltage line RVL2.

In step S20, the display device 100 may simultaneously perform the sensing driving of the white subpixel SPw1 connected to the first reference voltage line RVL1 and the sensing driving of the white subpixel SPw2 connected to the second reference voltage line RVL2.

In step S30, the display device 100 may simultaneously perform the sensing driving of the blue subpixel SPb1 connected to the first reference voltage line RVL1 and the sensing driving of the blue subpixel SPb2 connected to the second reference voltage line RVL2.

In step S40, the display device 100 may simultaneously perform the sensing driving of the green subpixel SPg1 connected to the first reference voltage line RVL1 and the sensing driving of the green subpixel SPg2 connected to the second reference voltage line RVL2.

As described above, in the sensing driving according to the first driving method, the subpixels SP of the same color may be simultaneously sensed using the first reference voltage line RVL1 and the second reference voltage line RVL2, since the data lines DLr1, DLw1, DLb1, DLg1, DLr2, DLw2, DLb2, and DLg2 may be separately and independently driven.

Referring to FIGS. 8 and 9, in the sensing driving according to the second driving method, the data lines DLr1, DLw1, DLb1, DLg1, DLr2, DLw2, DLb2, and DLg2 are not separately and independently driven. In a structure according to the second driving method, among the data lines DLr1, DLw1, DLb1, DLg1, DLr2, DLw2, DLb2, and DLg2, two data lines DL connected to two subpixels SP emitting the same color of light are simultaneously driven.

Thus, referring to FIG. 9, in the sensing driving according to the second driving method, the subpixels SP of different colors may be simultaneously sensed using the first reference voltage line RVL1 and the second reference voltage line RVL2.

For example, referring to FIG. 9, in the sensing driving according to the second driving method, the red subpixels and the blue subpixels may be simultaneously sensed and the white subpixels and the green subpixels may be simultaneously sensed using the first reference voltage line RVL1 and the second reference voltage line RVL2.

In step S10, the display device 100 may simultaneously perform the sensing driving of the red subpixel SPr1 connected to the first reference voltage line RVL1 and the sensing driving of the blue subpixel SPb2 connected to the second reference voltage line RVL2.

In step S20, the display device 100 may simultaneously perform the sensing driving of the white subpixel SPw1 connected to the first reference voltage line RVL1 and the sensing driving of the green subpixel SPg2 connected to the second reference voltage line RVL2.

In step S30, the display device 100 may simultaneously perform the sensing driving of the blue subpixel SPb1 connected to the first reference voltage line RVL1 and the sensing driving of the red subpixel SPr2 connected to the second reference voltage line RVL2.

In step S40, the display device 100 may simultaneously perform the sensing driving of the green subpixel SPg1 connected to the first reference voltage line RVL1 and the sensing driving of the white subpixel SPw2 connected to the second reference voltage line RVL2.

Figure 10A:
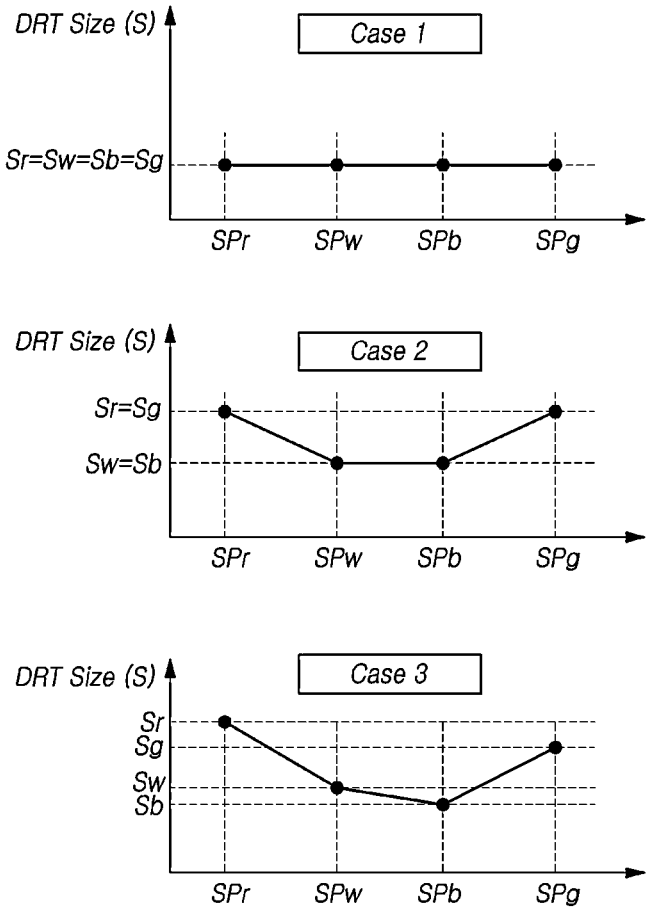
FIG. 10A illustrates graphs comparing the sizes S of driving transistors included in subpixels for four colors in the display device according to one or more example embodiments.
Figure 10B:
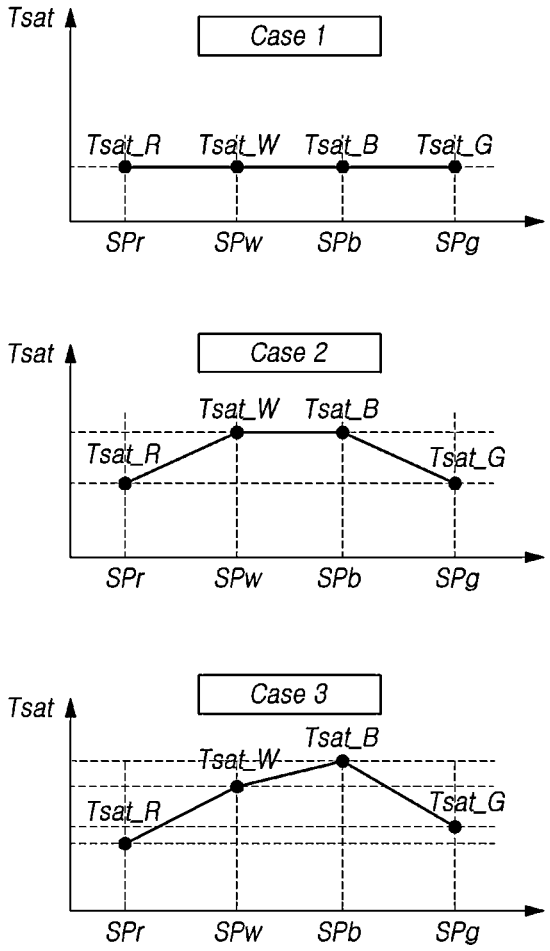
FIG. 10B illustrates graphs comparing saturation times required in the sensing driving of the subpixels for four colors in the display device according to one or more example embodiments.

FIG. 10A illustrates graphs comparing the sizes S (Sr, Sw, Sb, and Sg) of driving transistors DRT included in subpixels SPr, SPw, SPb, and SPg for 4 colors (red, white, blue, and green) in the display device 100 according to one or more example embodiments, and FIG. 10B illustrates graphs comparing saturation times Tsat (Tsat_R, Tsat_W, Tsat_B, and Tsat_G) required in the sensing driving of the subpixels SPr, SPw, SPb, and SPg for 4 colors (red, white, blue, and green) in the display device 100 according to one or more example embodiments when the relationship of the sizes Sr, Sw, Sb, and Sg of the driving transistors DRT included in the subpixels SPr, SPw, SPb, and SPg for 4 colors (red, white, blue, and green) has three cases as in FIG. 10A.

Referring to Case 1, the sizes Sr, Sw, Sb, and Sg of the driving transistors DRT included in the subpixels SPr, SPw, SPb, and SPg for 4 colors may be the same.

Referring to Case 2, in the subpixels for 4 colors (red, white, blue, and green), the sizes Sw and Sb of the driving transistors DRT included in the white subpixel SPw and the blue subpixel SPb, respectively, may be the same or have a difference only within a predetermined range. The sizes Sr and Sg of the driving transistors DRT included in the red subpixel SPr and the green subpixel SPg may be the same or have a difference only within a predetermined range.

Referring to Case 2, the sizes Sw and Sb of the driving transistors DRT included in the white subpixel SPw and the blue subpixel SPb, respectively, may be smaller than the sizes Sr and Sg of the driving transistors DRT included in the red subpixel SPr and the green subpixel SPg.

Referring to Case 3, all of the sizes Sr, Sw, Sb, and Sg of the driving transistors DRT included in the subpixels SPr, SPw, SPb, and SPg for 4 colors (red, white, blue, and green) may be different from each other.

In one or more examples, among the driving transistors DRT included in the subpixels SPr, SPw, SPb, and SPg for 4 colors (red, white, blue, and green), the size Sr of the driving transistor DRT included in the red subpixel SPr may be the largest, the size Sg of the driving transistor DRT included in the green subpixel SPg may be the second largest, the size Sw of the driving transistor DRT included in the white subpixel SPw may be the third largest, and the size Sb of the driving transistor DRT included in the blue subpixel SPb may be the smallest.

For example, the size of the driving transistor DRT may mean or indicate the channel size of the driving transistor DRT. Here, the channel size may be expressed by a value obtained by dividing the channel width with the channel length.

The larger the size (e.g., channel size) of the driving transistor DRT, the lower the channel resistance of the driving transistor DRT may be. Thus, current (e.g., driving current) flowing through the driving transistor DRT may be increased. In contrast, the smaller the size (e.g., channel size) of the driving transistor DRT, the higher the channel resistance of the driving transistor DRT may be, thereby reducing current (e.g., driving current) flowing through the driving transistor DRT.

During the tracking time Ttrack of the sensing driving time, the line capacitor Crvl on the reference voltage line RVL is charged with current supplied through the driving transistor DRT and the sensing transistor SENT. Thus, the voltage of the reference voltage line RVL may be increased.

Thus, the difference in the size (e.g., channel size) of the driving transistor DRT may cause a difference in the voltage rise rate of the reference voltage line RVL, thereby leading to a difference in the saturation time Tsat.

The size S of the driving transistor DRT may be inversely proportional to the saturation time Tsat. When the size (e.g., channel size) of the driving transistor DRT is larger, the flow of the current through the driving transistor DRT may be facilitated (e.g., the current flow through the driving transistor DRT may increase). The voltage rise rate of the reference voltage line RVL may be increased, and thus the saturation time Tsat may be reduced. When the size (e.g., channel size) of the driving transistor DRT is smaller, the flow of the current through the driving transistor DRT may not be easy (e.g., the current flow through the driving transistor DRT may be reduced). The voltage rise rate of the reference voltage line RVL may be reduced, and thus the saturation time Tsat may be increased.

Referring to FIG. 10B, as in Case 1 of FIG. 10A, when the sizes Sr, Sw, Sb, and Sg of the driving transistors DRT included in the subpixels SPr, SPw, SPb, and SPg for 4 colors (red, white, blue, and green) are the same, the saturation times Tsat (Tsat_R, Tsat_W, Tsat_B, and Tsat_G) required in the sensing driving of the subpixels SPr, SPw, SPb, and SPg for 4 colors (red, white, blue, and green) may be the same.

Referring to FIG. 10B, as in Case 2 of FIG. 10A, when the sizes Sw and Sb of the driving transistors DRT included in the white and blue subpixels SPw and SPb among the subpixels SPr, SPw, SPb, and SPg for 4 colors (red, white, blue, and green) are smaller than the sizes Sr and Sg of the driving transistor DRT included in the red and green subpixels SPr and SPg, the saturation times Tsat_W and Tsat_B for the white and blue subpixels SPw and SPb may be longer than the saturation times Tsat_R and Tsat_G for the red and green subpixels SPr and SPg.

Referring to FIG. 10B, as in Case 3 of FIG. 10A, when the sizes Sr, Sw, Sb, and Sg of the driving transistor DRT included in the subpixels SPr, SPw, SPb, and SPg for 4 colors (red, white, blue, and green) are different, the saturation times Tsat (Tsat_R, Tsat_W, Tsat_B, and Tsat_G) required in the sensing driving of the subpixels SPr, SPw, SPb, and SPg for 4 colors (red, white, blue, and green) may be different from each other.

For example, the saturation time Tsat_B for the blue subpixel SPb may be the longest, the saturation time Tsat_W for the white subpixel SPw may be the second longest, the saturation time Tsat_G for the green subpixel SPg may be the third longest, and the saturation time Tsat_R for the red subpixel SPr may be the shortest.

Figure 11:
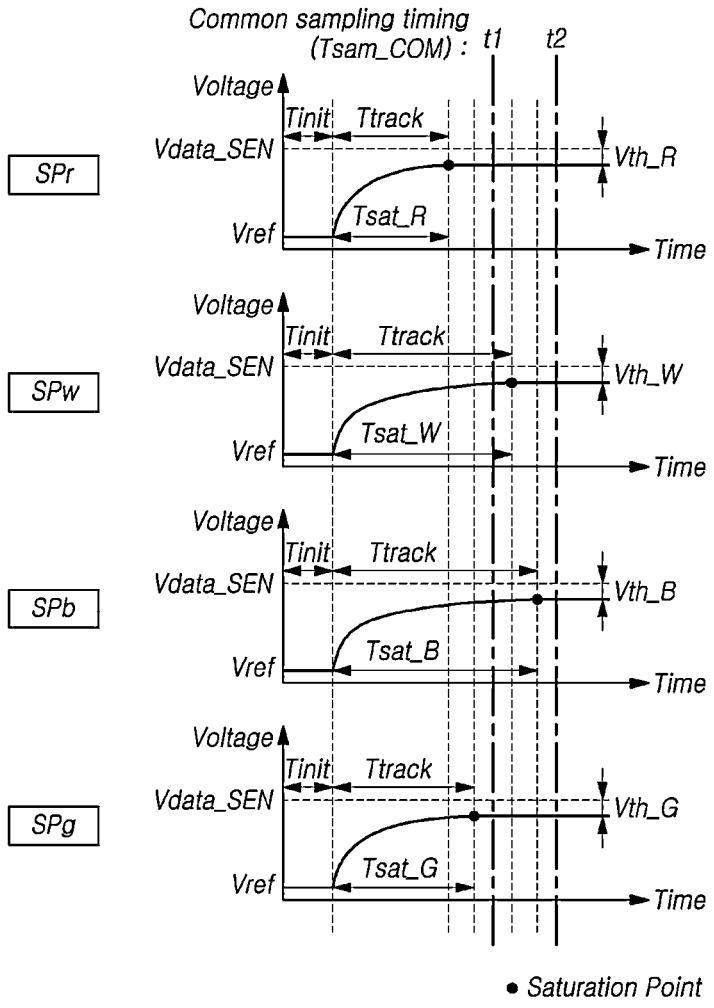
FIG. 11 depicts graphs illustrating changes in the voltage of the reference voltage line during the sensing driving time for the subpixels for four colors in the display device according to one or more example embodiments.

FIG. 11 depicts graphs illustrating changes in the voltage of the reference voltage line RVL during the sensing driving time for the subpixels SPr, SPw, SPb, and SPg for 4 colors (red, white, blue, and green) in the display device 100 according to one or more example embodiments. Here, the illustration of FIG. 11 is based on Case 3 in FIGS. 10A and 10B.

As described above, in Case 3, the saturation time Tsat_B for the blue subpixel SPb may be the longest, the saturation time Tsat_W for the white subpixel SPw may be the second longest, the saturation time Tsat_G for the green subpixel SPg may be the third longest, and the saturation time Tsat_R for the red subpixel SPr may be the shortest.

In one or more aspects, for accurate sensing of the threshold voltage Vth_R for the red subpixel SPr, the length of the tracking time Ttrack is required to be longer than at least the saturation time Tsat_R. Similarly, for accurate sensing of the threshold voltage Vth_W for the white subpixel SPw, the length of the tracking time Ttrack is required to be longer than at least the saturation time Tsat_W. Similarly, for accurate sensing of the threshold voltage Vth_B for the blue subpixel SPb, the length of the tracking time Ttrack is required to be longer than at least the saturation time Tsat_B. Similarly, for accurate sensing of the threshold voltage Vth_G for the green subpixel SPg, the length of the tracking time Ttrack is required to be longer than at least the saturation time Tsat_G.

Thus, in one or more aspects, for accurate sensing of each color without unnecessary time loss, the tracking time Ttrack is required to have different lengths for the red subpixel SPr, the white subpixel SPw, the blue subpixel SPb, and the green subpixel SPg, respectively.

That is, in one or more aspects, for accurate sensing of each color without unnecessary time loss, turn-on timing (hereinafter, referred to as sampling timing) of the sampling switch SAM is required to be set differently for each color of the red subpixel SPr, the white subpixel SPw, the blue subpixel SPb, and the green subpixel SPg. Consequently, color-specific sensing times may be different from each other, thereby significantly reducing sensing driving efficiency.

Referring to FIG. 11, in the sensing driving of each of the red subpixel SPr, the white subpixel SPw, the blue subpixel SPb, and the green subpixel SPg, common sampling timing Tsam_COM may be applied in order to improve the efficiency of the sensing driving.

Referring to FIG. 11, when the common sampling timing Tsam_COM is set to be later than the longest saturation time Tsat_B (see t2), in the sensing driving of each of the red subpixel SPr, the white subpixel SPw, the blue subpixel SPb, and the green subpixel SPg, the display device 100 may perform the sensing in a situation in which the reference voltage line RVL is completely saturated, thereby obtaining accurate threshold voltages Vth_R, Vth_W, Vth_B, and Vth_G.

However, in the red subpixel SPr and the green subpixel SPg in which the saturation occurs earlier, a standby time until the common sampling timing Tsam_COM is reached may be increased.

Referring to FIG. 11, when the common sampling timing Tsam_COM is set to be later than the saturation time Tsat_R of the red subpixel SPr and the saturation time Tsat_G of the green subpixel SPg and earlier than the saturation time Tsat_W of the white subpixel SPw and the saturation time Tsat_B of the blue subpixel SPb (see t1), the threshold voltages Vth_R and Vth_G of the red subpixel SPr and the green subpixel SPg may be accurately sensed but the threshold voltages Vth_W and Vth_B of the white subpixel SPw and the blue subpixel SPb may not be accurately sensed.

Thus, embodiments may provide a method capable of rapidly and accurately sensing the threshold voltages Vth_R, Vth_W, Vth_B, and Vth_G of the red subpixel SPr, the white subpixel SPw, the blue subpixel SPb, and the green subpixel SPg. In addition, embodiments may provide a method capable of synchronizing the sensing times of the red subpixel SPr, the white subpixel SPw, the blue subpixel SPb, and the green subpixel SPg.

Figure 12:
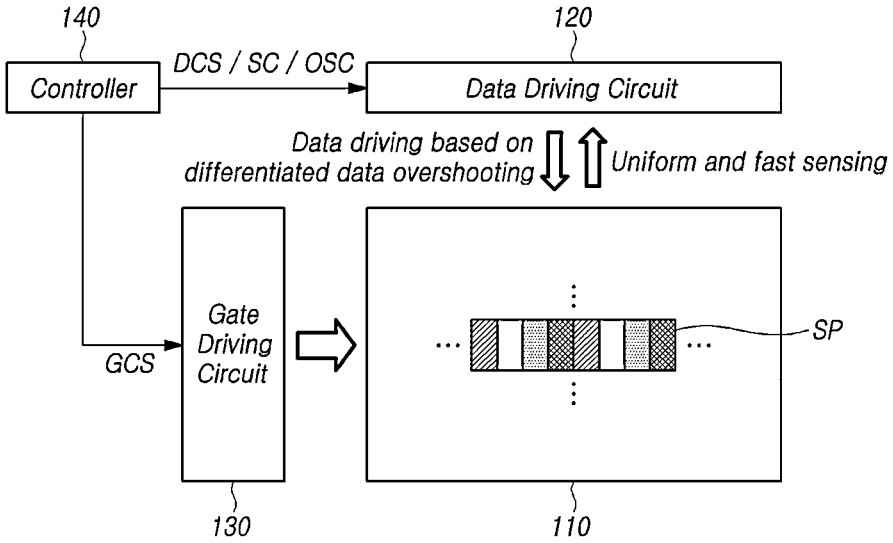
FIG. 12 is a diagram illustrating a sensing control system of the display device according to one or more example embodiments.

FIG. 12 is a diagram illustrating a sensing time reducing system of the display device 100 according to one or more example embodiments.

The display device 100 according to one or more example embodiments may include: the display panel 110 including a plurality of subpixels SP, a plurality of data lines DL, a plurality of gate lines GL, and a plurality of reference voltage lines RVL; the data driver circuit 120 configured to drive the plurality of data lines DL; the gate driver circuit 130 configured to drive the plurality of gate lines GL; the controller 140 configured to control the data driver circuit 120 and the gate driver circuit 130; and the like.

The sensing time reducing system of the display device 100 according to one or more example embodiments may include the controller 140, the data driver circuit 120, and the like.

In the sensing driving of a subpixel SP including a driving transistor DRT having a small channel size, the sensing time reducing system may reduce the sensing time by reducing the saturation time Tsat by data driving based on data overshooting. Here, the sensing time may mean or indicate the time length of the sensing driving time including the initialization time Tinit, the tracking time Ttrack, and the sampling time Tsam.

In the sensing time reducing system, the controller 140 may transfer a data drive control signal DCS, a sensing drive control signal SC, and an overshooting control signal OSC to the data driver circuit 120.

The data driver circuit 120 may perform data overshooting-based data driving using the overshooting control signal OSC received from the controller 140. For example, the overshooting control signal OSC may include information regarding at least one subpixel to which overshooting is applied, an overshooting voltage, an overshooting length, and the like.

A data signal Vdata transferred to the subpixel SP in response to the data overshooting-based data driving may include an overshooting section in which the voltage value of the data signal Vdata is higher than a reference driving voltage value Vdata_SEN and a reference signal section in which the data signal Vdata has the reference driving voltage value Vdata_SEN.

A voltage value higher than the reference driving voltage value Vdata_SEN may be a voltage value obtained by adding an overshooting voltage value to the reference driving voltage value Vdata_SEN. A time period in which the voltage value is higher than the reference driving voltage value Vdata_SEN may be referred to as an overshooting length. The reference driving voltage value Vdata_SEN may be a sensing driving data voltage value or a voltage value of a sensing driving data signal.

The sensing time reducing system of the display device 100 according to one or more example embodiments may perform differentiated data overshooting-based data driving in the sensing driving of a subpixel SP including a driving transistor DRT having a relatively small channel size and a subpixel SP including a driving transistor DRT having a relatively large channel size.

According to one or more aspects of the differentiated data overshooting-based data driving, the data signal Vdata including the overshooting section and the reference signal section may be transferred to the subpixel SP including the driving transistor DRT having a relatively small channel size. In addition, a data signal Vdata only including the reference signal section may be transferred to the subpixel SP including the driving transistor DRT having a relatively large channel size.

According to one or more aspects of the differentiated data overshooting-based data driving, a channel sensing time for the subpixel SP including the driving transistor DRT having a relatively small channel size may be reduced. Thus, the sensing time for the subpixel SP including the driving transistor DRT having a relatively small channel size may be the same as the sensing time for the subpixel SP including the driving transistor DRT having a relatively large channel size.

In addition, according to one or more aspects of the differentiated data overshooting-based data driving, a data signal Vdata including the overshooting section having a relatively higher overshooting voltage and the reference signal section may be transferred to the subpixel SP including the driving transistor DRT having a relatively small channel size. In addition, the data signal Vdata including the overshooting section having a relatively low overshooting voltage and the reference signal section may be transferred to the subpixel SP including the driving transistor DRT having a relatively large channel size.

According to one or more aspects of the differentiated data overshooting-based data driving, the sensing time for the subpixel SP including the driving transistor DRT having a small channel size may be significantly reduced, and the sensing time for the subpixel SP including the driving transistor DRT having a large channel size may be slightly reduced. Thus, the sensing time for the subpixel SP including the driving transistor DRT having a small channel size may be the same as the sensing time for the subpixel SP including the driving transistor DRT having a large channel size.

Figure 13:
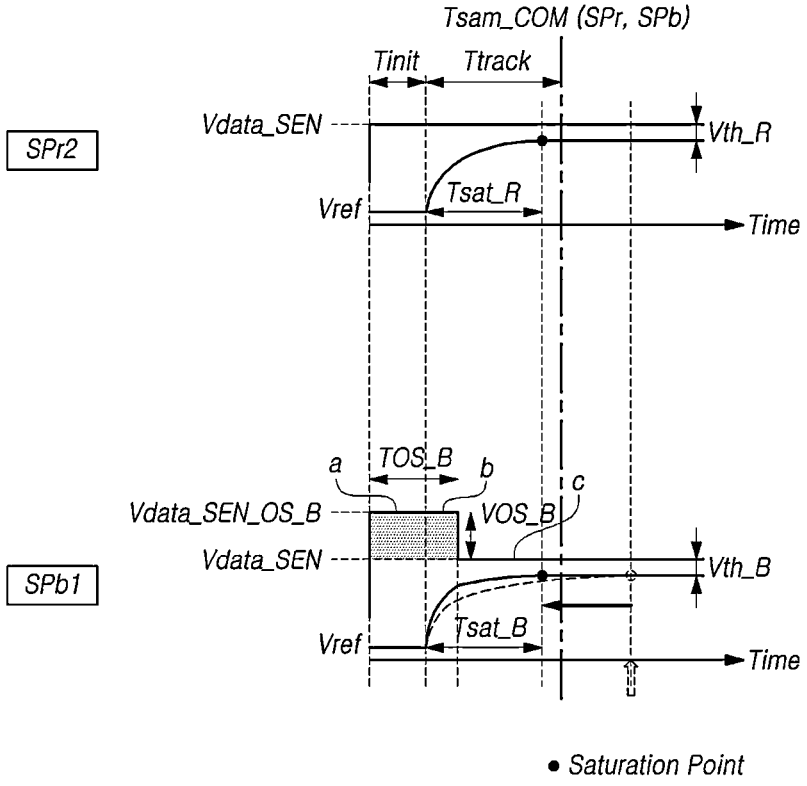
FIG. 13 illustrates a sensing driving waveform for a red subpixel and a sensing driving waveform for a blue subpixel when the sensing time reducing system according to one or more example embodiments performs sensing driving of the red subpixel and the blue subpixel using the differentiated data overshooting-based data driving.

FIG. 13 illustrates a sensing driving waveform for a red subpixel SPr2 and a sensing driving waveform for a blue subpixel SPb1 when the sensing time reducing system according to one or more example embodiments performs sensing driving of the red subpixel SPr2 and the blue subpixel SPb1 using the differentiated data overshooting-based data driving.

Meanwhile, in the following description, FIGS. 6 and 7 related to the first driving method, FIGS. 8 and 9 related to the second driving method, and FIG. 10A related to the size S of the driving transistor DRT are also referred to.

The blue subpixel SPb1 illustrated in FIG. 13 is the blue subpixel SPb connected to the first reference voltage line RVL1 in FIGS. 6 and 8, and, hereinafter, may be referred to as a first subpixel. The red subpixel SRr2 illustrated in FIG. 13 is the red subpixel SPr connected to the second reference voltage line RVL2 in FIGS. 6 and 8, and, hereinafter, may be referred to as a second subpixel.

The sensing driving waveform of the red subpixel SPr2 illustrated in FIG. 13 includes a signal waveform of the data signal Vdata transferred to the red subpixel SPr2 and changes in the voltage of the second reference voltage line RVL2 connected to the red subpixel SPr2. The sensing driving waveform of the red subpixel SPr2 illustrated in FIG. 13 is a sensing driving waveform in the tracking time Ttrack.

The sensing driving waveform of the blue subpixel SPb1 illustrated in FIG. 13 includes a signal waveform of the data signal Vdata transferred to the blue subpixel SPb1 and changes in the voltage of the first reference voltage line RVL1 connected to the blue subpixel SPb1. The sensing driving waveform of the blue subpixel SPb1 illustrated in FIG. 13 is a sensing driving waveform in the tracking time Ttrack.

Referring to FIGS. 6 and 8, the first subpixel SPb1, i.e., the blue subpixel SPb1, may be connected to a first data line DLb1 among a plurality of data lines DL and a first reference voltage line RVL1 among a plurality of reference voltage lines RVL.

The driving time (e.g., sensing driving time) of the first subpixel SPb1 may include a first initialization time Tinit in which a reference voltage Vref is applied to the first reference voltage line RVL1 and a first tracking time Ttrack in which the voltage of the first reference voltage line RVL1 increases from the reference voltage Vref.

For example, referring to FIG. 10A, the first subpixel SPb1 may be a subpixel (e.g., a blue subpixel) including a driving transistor DRT having the smallest channel size among the subpixels SPr, SPw, SPb, and SPg for 4 colors.

As illustrated in FIG. 13, in the sensing driving of the first subpixel SPb1, the first data signal Vdata transferred to the first subpixel SPb1 may be a data signal including an overshooting section a and b and a reference signal section c in order to reduce the sensing time for the first subpixel SPb1.

Referring to FIG. 13, during the first tracking time Ttrack, the first data signal Vdata transferred to the first subpixel SPb1 through the first data line DLb1 may be changed from a first voltage value Vdata_SEN_OS_B to the reference driving voltage value Vdata_SEN.

Referring to FIG. 13, during the overshooting section a and b of the first data signal Vdata, the first voltage value Vdata_SEN_OS_B of the first data signal Vdata may be higher than the reference driving voltage value Vdata_SEN.

Thus, the voltage of the first reference voltage line RVL1 may increase at a higher rate. That is, since the first data signal Vdata has the first voltage value Vdata_SEN_OS_B higher than the reference driving voltage value Vdata_SEN, the voltage of the first reference voltage line RVL1 may increase at a higher rate. Thus, the saturation time Tsat_B may be further reduced.

During the first tracking period Track, since a sensing transistor SENT included in the first subpixel SPb1 is turned on, the first reference voltage line RVL1 may be electrically connected to a second node N2 of the driving transistor DRT included in the first subpixel SPb1. Thus, during the sensing driving time, the voltage of the first reference voltage line RVL1 may correspond to a voltage on the second node N2 of the driving transistor DRT included in the first sub pixel SPb1.

In the first data signal Vdata transferred to the first subpixel SPb1, the difference between the first voltage value Vdata_SEN_OS_B and the reference driving voltage value Vdata_SEN may be referred to as an overshooting voltage VOS_B, whereas the time length of the overshooting section a and b may be referred to as an overshooting length TOS_B. In one or more aspects, the time length of the overshooting section a and b is the time length until the voltage of the first data signal Vdata becomes the reference driving voltage value Vdata_SEN after the start of an initialization time Tinit. The voltage of the first data signal Vdata may be detected from the first data line DLb1.

In the first data signal Vdata transferred to the first subpixel SPb1, the overshooting voltage VOS_B and the overshooting length TOS_B may be controllable factors.

Referring to FIGS. 6 and 8, the second subpixel SPr2, i.e., the red subpixel SPr, may be connected to a second data line DLr2 among the plurality of data lines DL and a second reference voltage line RVL2 among the plurality of reference voltage lines RVL.

The driving time (e.g., sensing driving time) of the second subpixel SPr2 may include a second initialization time Tinit in which the reference voltage Vref is applied to the second reference voltage line RVL2 and a second tracking time Ttrack in which the voltage of the second reference voltage line RVL2 increases from the reference voltage Vref.

For example, the second subpixel SPr2 illustrated in FIG. 13 may be a subpixel (e.g., a red subpixel) including a driving transistor DRT having the largest channel size among the subpixels SPr, SPw, SPb, and SPg for 4 colors.

During the second tracking time Ttrack, a second data signal Vdata transferred to the second subpixel SPr2 through the second data line DLr2 may maintain the reference driving voltage value Vdata_SEN. That is, during the second tracking time Ttrack, the second data signal Vdata transferred to the second subpixel SPr2 through the second data line DLr2 may only include the reference signal section without including the overshooting section.

Referring to FIG. 13, in the sensing driving of the second subpixel SPr2, even in the case in which the second data signal Vdata without the data overshooting is transferred to the second subpixel SPr2, the voltage of the second reference voltage line RVL2 connected to the second subpixel SPr2 may be rapidly saturated during the second tracking time Ttrack, due to the large channel size of the driving transistor DRT in the second subpixel SPr2.

Referring to FIG. 13, in the sensing driving of the first subpixel SPb1, as the first data signal Vdata is transferred to the first subpixel SPb1 by the data overshooting-based data driving, the voltage of the first reference voltage line RVL1 connected to the first subpixel SPb1 may be rapidly saturated during the first tracking time Ttrack. That is, the saturation time Tsat_B in the first subpixel SPb1 may be reduced by the data overshooting-based data driving. In other words, a point in time psb_os at which the voltage of the first reference voltage line RVL1 is saturated in the sensing driving of the first subpixel SPb1 to which the overshooting-based data driving is applied may be earlier than a point in time psb at which the voltage of the first reference voltage line RVL1 is saturated in the sensing driving of the first subpixel SPb1 in which the overshooting-based data driving is not applied.

Through the differentiated data overshooting-based data driving, the reduced saturation time Tsat_B in the first subpixel SPb1 may be the same as the saturation time Tsat_R in the second subpixel SPr2.

In one or more aspects, at least one of the overshooting voltage VOS_B and the overshooting length TOS_B of the first data signal Vdata may be controlled so that the reduced saturation time Tsat_B in the first subpixel SPb1 is the same as the saturation time Tsat_R in the second subpixel SPr2.

Referring to FIG. 13, after both the saturation time Tsat_B in the first subpixel SPb1 and the saturation time Tsat_R in the second subpixel SPr2 are reached, the common sampling timing Tsam_COM may be set rapidly. Thus, the sensing time for the first subpixel SPb1 and the sensing time for the second subpixel SPr2 may not only be synchronized but also be reduced.

As described above, regardless of the synchronization and reduction of the sensing times, the threshold voltage Vth_B of the driving transistor DRT in the first subpixel SPb1 and the threshold voltage Vth_R of the driving transistor DRT in the second subpixel SPr2 may be accurately sensed.

For example, the second subpixel SPr2 illustrated in FIG. 13 may be a subpixel (e.g., a white subpixel or a green subpixel) including a driving transistor DRT having the second or third largest channel size among the subpixels SPr, SPw, SPb, and SPg for 4 colors.

In this case, during the second tracking time Ttrack, the second data signal Vdata supplied to the second subpixel SPr2 through the second data line DLr2 may include the overshooting section and the reference signal section.

Thus, during the second tracking time Ttrack, the second data signal Vdata transferred to the second subpixel SPr2 through the second data line DLr2 may be changed from a second voltage value to the reference driving voltage value Vdata_SEN. The second voltage value may be higher than the reference driving voltage value Vdata_SEN. However, the second voltage value may be lower than the first voltage value Vdata_SEN_OS_B.

Referring to FIGS. 6 and 8, the data driver circuit 120 may include an analog-to-digital converter ADC, a first sampling switch SAM1, and a second sampling switch SAM2.

The analog-to-digital converter ADC may output the voltage of the first reference voltage line RVL1 or the voltage of the second reference voltage line RVL2 as a sensing value corresponding to a digital value.

The first sampling switch SAM1 may be a switch connecting the analog-to-digital converter ADC and the first reference voltage line RVL1. The second sampling switch SAM2 may be a switch connecting the analog-to-digital converter ADC and the second reference voltage line RVL2.

When the first sampling switch SAM1 is turned on, the first reference voltage line RVL1 may be in a saturated state. When the second sampling switch SAM2 is turned on, the second reference voltage line RVL2 may be in a saturated state.

Both the first sampling switch SAM1 and the second sampling switch SAM2 may be turned on at the same time.

Each of the first subpixel SPb1 and the second subpixel SPr2 may include an emitting device ED and a driving transistor DRT for supplying current to the emitting device ED. The size Sb of the driving transistor DRT of the first subpixel SPb1 may be smaller than the size Sr of the driving transistor DRT of the second subpixel SPr2.

Each of the first subpixel SPb1 and the second subpixel SPr2 may include an emitting device ED and a driving transistor DRT for supplying current to the emitting device ED.

During the first tracking time Ttrack, a first time TOS_B in which the first voltage value Vdata_SEN_OS_B is changed to the reference driving voltage value Vdata_SEN may be controlled. In one or more aspects, the first time TOS_B is an overshooting length. In other words, during the first tracking time Ttrack, a first time TOS_B in which the first data signal has the first voltage value Vdata_SEN_OS_B may be controlled. After the first time TOS_B, the first data signal may have the reference driving voltage value Vdata_SEN. The reference driving voltage value Vdata_SEN may be a lower voltage value than the first voltage value Vdata_SEN_OS_B.

During the first tracking time Ttrack, the longer the first time TOS_B in which the first voltage value Vdata_SEN_OS_B is changed to the reference driving voltage value Vdata_SEN, the shorter the saturation time Tsat_B may be. In other words, during the first tracking time Ttrack, the longer the first time TOS_B in which the first data signal has the first voltage value Vdata_SEN_OS_B, the shorter the saturation time Tsat_B may be.

For example, when the second subpixel SPr2 illustrated in FIG. 13 is a subpixel (e.g., a white subpixel or a green subpixel) including a driving transistor DRT having the second or third largest channel size among the subpixels SPr, SPw, SPb, and SPg for 4 colors, the second data signal Vdata transferred to the second subpixel SPr2 through the second data line DLr2 may include the overshooting section and the reference signal section during the second tracking time Ttrack.

In this case, the first time TOS_B in which the first voltage value Vdata_SEN_OS_B is changed to the reference driving voltage value Vdata_SEN during the first tracking time Ttrack may be longer than a second time in which the second voltage value is changed to the reference driving voltage value Vdata_SEN during the second tracking time Ttrack. In other words, the first time TOS_B in which the first data signal has the first voltage value Vdata_SEN_OS_B during the first tracking time Ttrack may be longer than a second time in which the second data signal has the second voltage value during the second tracking time Ttrack.

The first subpixel SPb1 may emit light having a first color. The second subpixel SPr2 may emit light having a second color different from the first color. For example, the first subpixel SPb1 may emit blue light, whereas the second subpixel SPr2 may emit red light.

According to one or more aspects of the first driving method (e.g., a single-rate driving method) illustrated in FIGS. 6 and 7, subpixels SP for the same color may be simultaneously sensed, and subpixels SP for different colors may not be simultaneously sensed. Here, the first driving method may also be referred to as the single-rate driving method.

According to one or more aspects of the first driving method, the driving time of the first subpixel SPb1 emitting light having the first color and the driving time second subpixel SPr2 emitting light having the second color may not overlap in time.

According to one or more aspects of the second driving method illustrated in FIGS. 8 and 9, subpixels SP having the same color may not be simultaneously sensed, but subpixels SP having different colors may be simultaneously sensed. Here, the second driving method will also be referred to as a double-rate driving method.

According to one or more aspects of the second driving method, the driving time of the first subpixel SPb1 emitting light having the first color and the driving time of the second subpixel SPr2 emitting light having the second color may overlap in time.

Referring to FIGS. 6 to 9, the plurality of subpixels SP may further include a third subpixel SPb2 and a fourth subpixel SPr1 disposed on the same subpixel line as the first subpixel SPb1 and second subpixel SPr2.

The third subpixel SPb2 is the blue subpixel SPb connected to the second reference voltage line RVL2 in FIGS. 6 to 9, whereas the fourth subpixel SPr1 is the red subpixel SPr connected to the first reference voltage line RVL1 in FIGS. 6 and 8.

Referring to FIGS. 6 to 9, the third subpixel SPb2 may be connected to a third data line DLb2 among the plurality of data lines DL, and together with the second subpixel SPr2, be connected to the second reference voltage line RVL2. The fourth subpixel SPr1 may be connected to a fourth data line DLr1 among the plurality of data lines DL, and together with the first subpixel SPb1, be connected to the first reference voltage line RVL1.

Referring to FIGS. 6 to 9, the first subpixel SPb1 and the third subpixel SPb2 may be subpixels emitting light having the first color (e.g., blue), whereas the second subpixel SPr2 and fourth subpixel SPr1 may be subpixels emitting light having the second color (e.g., red) different from the first color (e.g., blue).

Referring to FIGS. 8 and 9, when the sensing driving is performed by the second driving method, the driving time of the first subpixel SPb1 and the driving time of the second subpixel SPr2 may overlap in time, and the driving time of the third subpixel SPb2 and the driving time of the fourth subpixel SPr1 may overlap in time.

Referring to FIGS. 8 and 9, when the sensing driving is performed by the second driving method, the driving time of the first subpixel SPb1 and the driving time of the second subpixel SPr2 may not overlap the driving time of the third subpixel SPb2 and the driving time of the fourth subpixel SPr1.

Referring to FIGS. 6 and 7, when the sensing driving is performed by the first driving method, the driving time of the first subpixel SPb1 and the driving time of the second subpixel SPr2 may not overlap in time, and the driving time of the third subpixel SPb2 and the driving time of the fourth subpixel SPr1 may not overlap in time.

Referring to FIGS. 6 and 7, when the sensing driving is performed by the first driving method, the driving time of the first subpixel SPb1 and the driving time of the third subpixel SPb2 may overlap in time, and the driving time of the second subpixel SPr2 and the driving time of the fourth subpixel SPr1 may overlap in time.

Referring to FIG. 6, when the sensing driving is performed by the first driving method, the data driver circuit 120 may include a first data channel terminal CHb1 connected to the first data line DLb1, a second data channel terminal CHr2 connected to the second data line DLr2, a third data channel terminal CHb2 connected to the third data line DLb2, and a fourth data channel terminal CHr1 connected to the fourth data line DLr1.

Referring to FIG. 8, when the sensing driving is performed by the second driving method, the data driver circuit 120 may include a first data channel terminal CHb connected to both the first data line DLb1 and the third data line DLb2 and a second data channel terminal CHr connected to both the second data line DLr2 and the fourth data line DLr1.

The data driver circuit 120 included in the display device 100 according to one or more example embodiments may perform the differentiated data overshooting-based data driving.

The data driver circuit 120 included in the display device 100 according to one or more example embodiments may include the first data channel terminal CHb1 or CHb to which the first data line DLb1 is connected, the data signal provider 300 outputting the first data signal Vdata to the first data channel terminal CHb1 or CHb, the first sensing channel terminal ST1 connected to the first reference voltage line RVL1, the analog-to-digital converter ADC sensing the voltage of the first sensing channel terminal ST1, the first sampling switch SAM1 switching electrical connection between the first sensing channel terminal ST1 and the analog-to-digital converter ADC, and the first power switch SPRE1 switching electrical connection between the first sensing channel terminal ST1 and the reference voltage application node Nref.

The first data line DLb1 and the first reference voltage line RVL1 may be connected to the first subpixel SPb1.

The driving time of the first subpixel SPb1 may include the first initialization time Tinit in which the first power switch SPRE1 is turned on and the reference voltage Vref is applied to the first reference voltage line RVL1 and the first tracking time Ttrack in which the first power switch SPRE1 is turned off and the voltage of the first reference voltage line RVL1 increases from the reference voltage Vref.

During the first tracking time Ttrack, the first data signal Vdata output to the first data channel terminal CHb1 or CHb may be changed from the first voltage value Vdata_SEN_OS_B to the reference driving voltage value Vdata_SEN. The first voltage value Vdata_SEN_OS_B may be higher than reference driving voltage value Vdata_SEN.

The data driver circuit 120 of the display device 100 according to one or more example embodiments may further include the second data channel terminal CHr2 or CHr to which the second data line DLr2 is connected, the second sensing channel terminal ST2 connected to the second reference voltage line RVL2, the second sampling switch SAM2 switching electrical connection between the second sensing channel terminal ST2 and the analog-to-digital converter ADC, and the second power switch SPRE2 switching electrical connection between the second sensing channel terminal ST2 and the reference voltage application node.

The data signal provider 300 may output the second data signal Vdata to the second data channel terminal CHr2 or CHr.

The driving time of the second subpixel SPr2 may include the second initialization time Tinit in which the second power switch is turned on and the reference voltage Vref is applied to the second reference voltage line RVL2 and the second tracking time Ttrack in which the second power switch is turned off and the voltage of the second reference voltage line RVL2 increases from the reference voltage Vref.

During the second tracking time Ttrack, the second data signal Vdata output to the second data channel terminal CHr2 or CHr may maintain the reference driving voltage value Vdata_SEN.

Alternatively, in some cases, during the second tracking time Ttrack, the second data signal Vdata output to the second data channel terminal CHr2 or CHr may be changed from the second voltage value to the reference driving voltage value Vdata_SEN.

The second voltage value may be higher than the reference driving voltage value Vdata_SEN. The second voltage value may be lower than first voltage value Vdata_SEN_OS_B.

The size of the driving transistor DRT in the first subpixel SPb1 may be smaller than the size of the driving transistor DRT in the second subpixel SPr2.

According to one or more aspects of the second driving method, the first data channel terminal CHb may be connected to both the first data line DLb1 and the third data line DLb2. The third data line DLb2 may be connected to the third subpixel SPb2. The third subpixel SPb2 may emit light having the first color the same as the color of light emitted from the first subpixel SPb1. The third subpixel SPb2 and the second subpixel SPr2 may be connected in common to the second reference voltage line RVL2.

The second data channel terminal CHr may be connected to both the second data line DLr2 and the fourth data line DLr1. The fourth data line DLr1 may be connected to the fourth subpixel SPr1. The fourth subpixel SPr1 may emit light having the second color the same as the color of light emitted from the second subpixel SPr2. The fourth subpixel SPr1 and the first subpixel SPb1 may be connected in common to the first reference voltage line RVL1.

Figure 14:
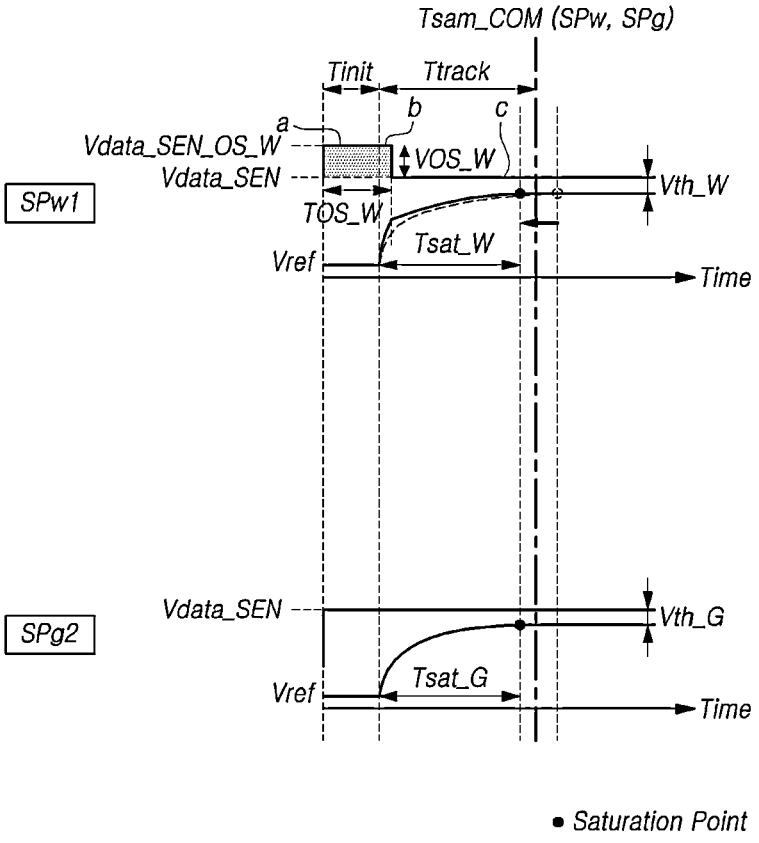
FIG. 14 illustrates a sensing driving waveform for a white subpixel and a sensing driving waveform for a green subpixel when the sensing time reducing system according to one or more example embodiments performs sensing driving of the white subpixel and the green subpixel using the differentiated data overshooting-based data driving.

FIG. 14 illustrates a sensing driving waveform for a white subpixel SPw1 and a sensing driving waveform for a green subpixel SPg2 when the sensing time reducing system according to one or more example embodiments performs sensing driving of the white subpixel SPw1 and the green subpixel SPg2 using the differentiated data overshooting-based data driving.

The white subpixel SPw1 illustrated in FIG. 14 is the white subpixel SPw connected to the first reference voltage line RVL1 in FIGS. 6 and 8, and hereinafter, may also be referred to as a fifth subpixel. The green subpixel SPg2 illustrated in FIG. 14 is the green subpixel SPg connected to the second reference voltage line RVL2 illustrated in FIGS. 6 and 8, and hereinafter, may also be referred to as sixth subpixel.

The sensing driving waveform for the green subpixel SPg2 illustrated in FIG. 14 includes a signal waveform of the data signal Vdata transferred to the green subpixel SPg2 and changes in the voltage of the second reference voltage line RVL2 connected to the green subpixel SPg2. The sensing driving waveform for the green subpixel SPg2 illustrated in FIG. 14 is a sensing driving waveform in the tracking time Ttrack.

The sensing driving waveform for the white subpixel SPw1 illustrated in FIG. 14 incudes a signal waveform of the data signal Vdata supplied to the white subpixel SPw1 and changes in the voltage of the first reference voltage line RVL1 connected to the white subpixel SPw1. The sensing driving waveform for the white subpixel SPw1 illustrated in FIG. 14 is the sensing driving waveform in the tracking time Ttrack.

Referring to FIGS. 6 and 8, the fifth subpixel SPw1, i.e., the white subpixel SPw1, may be connected to a fifth data line DLw1 among the plurality of data lines DL and the first reference voltage line RVL1 among the plurality of reference voltage lines RVL.

The driving time (e.g., sensing driving time) of the fifth subpixel SPw1 may include an initialization time Tinit in which the reference voltage Vref is applied to the first reference voltage line RVL1 and a tracking time Ttrack in which the voltage of the first reference voltage line RVL1 increases from the reference voltage Vref.

For example, in Case 3 of FIG. 10A, the fifth subpixel SPw1 may be a subpixel (e.g., a white subpixel) including a driving transistor DRT having the second smallest channel size among the subpixels SPr, SPw, SPb, and SPg for 4 colors.

Thus, as illustrated in FIG. 14, in the sensing driving of the fifth subpixel SPw1, the fifth data signal Vdata transferred to the fifth subpixel SPw1 may be a data signal including the overshooting section a and b and the reference signal section c in order to reduce the sensing time for the fifth subpixel SPw1.

Referring to FIG. 14, during the tracking time Ttrack, the fifth data signal Vdata transferred to the fifth subpixel SPw1 through the fifth data line DLw1 may be changed from a fifth voltage value Vdata_SEN_OS_W to the reference driving voltage value Vdata_SEN.

Referring to FIG. 14, during the overshooting section a and b of the fifth data signal Vdata, the fifth voltage value Vdata_SEN_OS_W of the fifth data signal Vdata may be higher than the reference driving voltage value Vdata_SEN. Thus, the voltage of the first reference voltage line RVL1 may increase at a much higher rate. That is, since the fifth data signal Vdata has the fifth voltage value Vdata_SEN_OS_W rather than the reference driving voltage value Vdata_SEN, the voltage of the first reference voltage line RVL1 may increase at a much higher rate. Thus, the saturation time Tsat_W may be further reduced.

Since the sensing transistor SENT included in the fifth subpixel SPw1 is turned on during the tracking time Ttrack, the first reference voltage line RVL1 may be electrically connected to the second node N2 of the driving transistor DRT of the fifth subpixel SPw1. Thus, during the sensing driving time, the voltage of the first reference voltage line RVL1 may correspond to the voltage of the second node N2 of the driving transistor DRT of the fifth subpixel SPw1.

In the fifth data signal Vdata transferred to the fifth subpixel SPw1, the difference between the fifth voltage value Vdata_SEN_OS_W and the reference driving voltage value Vdata_SEN is referred to as an overshooting voltage VOS_W, and the time length of the overshooting section a and b is referred to as an overshooting length TOS_W. The time length of the overshooting section a and b is a time length until the reference driving voltage value Vdata_SEN is reached after the start of the initialization time Tinit.

In the fifth data signal Vdata transferred to the fifth subpixel SPw1, the overshooting voltage VOS_W and the overshooting length TOS_W may be controllable factors.

When the channel size of the driving transistor DRT of the fifth subpixel SPw1 is larger than the channel size of the driving transistor DRT of the first subpixel SPb1, the overshooting voltage VOS_W in the fifth data signal Vdata transferred to the fifth subpixel SPw1 may be smaller than the overshooting voltage VOS_B in the first data signal Vdata transferred to the first subpixel SPb1.

When the channel size of the driving transistor DRT of the fifth subpixel SPw1 is larger than the channel size of the driving transistor DRT of the first subpixel SPb1, the overshooting length TOS_W in the fifth data signal Vdata transferred to the fifth subpixel SPw1 may be smaller than the overshooting length TOS_B in the first data signal Vdata transferred to the first subpixel SPb1.

The sixth subpixel SPg2, i.e., the green subpixel SPg2, may be connected to a sixth data line DLg2 among the plurality of data lines DL and the second reference voltage line RVL2 among the plurality of reference voltage lines RVL.

The driving time (e.g., sensing driving time) of the sixth subpixel SPg2 may include the initialization time Tinit in which the reference voltage Vref is applied to the second reference voltage line RVL2 and the tracking time Ttrack in which the voltage of the second reference voltage line RVL2 increases from the reference voltage Vref.

For example, according to Case 3 of FIG. 10A, the sixth subpixel SPg2 illustrated in FIG. 14 may be a subpixel (e.g., a green subpixel) including a driving transistor DRT having the second largest channel size among the subpixels SPr, SPw, SPb, and SPg for 4 colors.

Thus, during the tracking time Ttrack, the sixth data signal Vdata transferred to the sixth subpixel SPg2 through the sixth data line DLg2 may maintain the reference driving voltage value Vdata_SEN. That is, during the tracking time Ttrack, the sixth data signal Vdata transferred to the sixth subpixel SPg2 through the sixth data line DLg2 may only include the reference signal section without including the overshooting section.

Referring to FIG. 14, in the sensing driving of the sixth subpixel SPg2, even in the case in which the sixth data signal Vdata without the data overshooting is transferred to the sixth subpixel SPg2, the voltage of the second reference voltage line RVL2 connected to the sixth subpixel SPg2 may be rapidly saturated during the tracking time Ttrack, since the channel size of the driving transistor DRT in the sixth subpixel SPg2 is significantly large.

Referring to FIG. 14, in the sensing driving of the fifth subpixel SPw1, the fifth data signal Vdata is transferred to the fifth subpixel SPw1 by the data overshooting-based data driving. During the tracking time Ttrack, the voltage of the first reference voltage line RVL1 connected to the fifth subpixel SPw1 may be rapidly saturated. That is, by the data overshooting-based data driving, the saturation time Tsat_W in the fifth subpixel SPw1 may be reduced. In other words, a point in time psw_os at which the voltage of the first reference voltage line RVL1 reaches a saturated state in the sensing driving of the fifth subpixel SPw1 to which the overshooting-based data driving is applied may be earlier than a point in time psw at which the voltage of the first reference voltage line RVL1 reaches a saturated state in the sensing driving of the fifth subpixel SPw1 to which the overshooting-based data driving is not applied.

By the differentiated data overshooting-based data driving, the reduced saturation time Tsat_W in the fifth subpixel SPw1 may be the same as the saturation time Tsat_G in the sixth subpixel SPg2.

At least one of the overshooting voltage VOS_B and the overshooting length TOS_B of the fifth data signal Vdata may be controlled so that the reduced saturation time Tsat_W in the fifth subpixel SPw1 and the saturation time Tsat_G in the sixth subpixel SPg2 are the same.

Referring to FIG. 14, after both the saturation time Tsat_W in the fifth subpixel SPw1 and the saturation time Tsat_G in the sixth subpixel SPg2 are reached, common sampling timing Tsam_COM may be rapidly set. Thus, the sensing time of the fifth subpixel SPw1 and the sensing time of the sixth subpixel SPg2 may be not only synchronized but also be reduced.

As described above, regardless of the synchronization and reduction of the sensing times, the threshold voltage Vth_B of the driving transistor DRT in the fifth subpixel SPw1 and the threshold voltage Vth_R of the driving transistor DRT in the sixth subpixel SPg2 may be accurately sensed.

Referring to FIG. 13, the display device 100 may perform the sensing driving of the blue subpixel SPb1 by the data overshooting-based data driving so as to reduce a sensing time for the blue subpixel SPb1. The display device 100 may set the sensing time for blue subpixel SPb1 to be the same as a sensing time for the red subpixel SPr.

Referring to FIG. 14, the display device 100 may perform the sensing driving of the white subpixel SPw1 by the data overshooting-based data driving so as to reduce a sensing time for the white subpixel SPw1. The display device 100 may set the sensing time for the white subpixel SPw1 to be the same as a sensing time for the green subpixel SPg2.

The display device 100 according to one or more example embodiments may set all of the sensing times for the red subpixel SPr, the white subpixel SPw1, the blue subpixel SPb1, and the green subpixel SPg2 to be the same. This will be described with reference to FIGS. 15 and 16.

Figure 15:
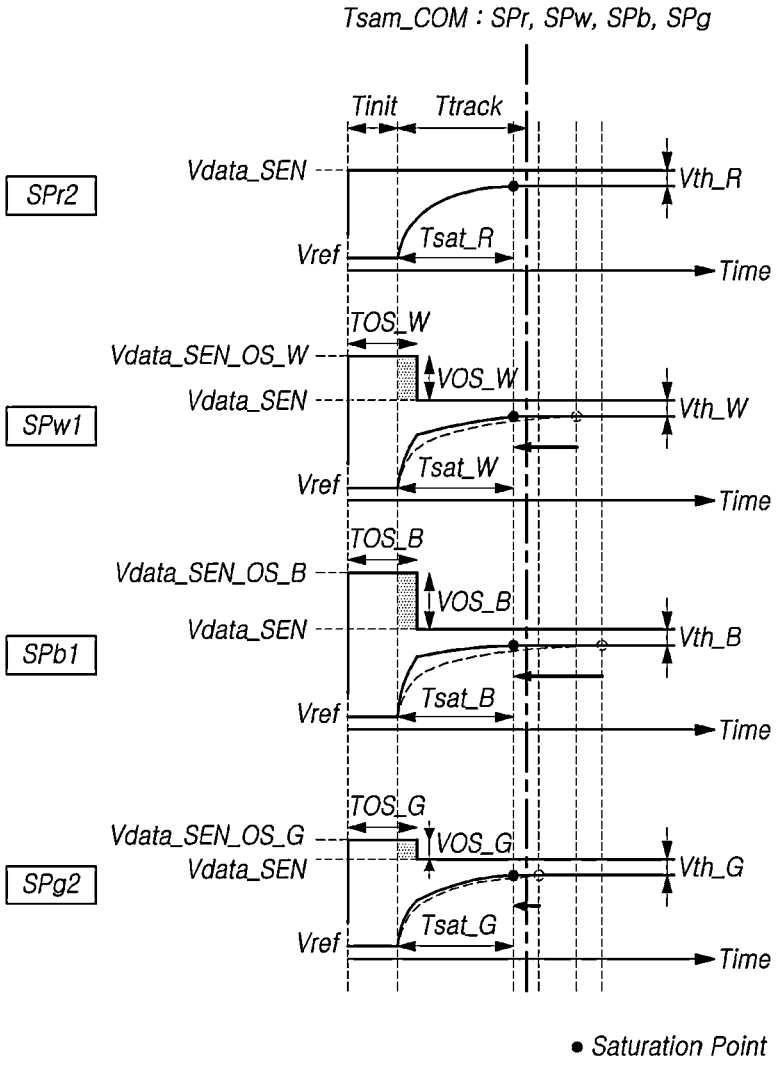
FIGS. 15 and 16 are graphs illustrating sensing driving waveforms for a red subpixel, a white subpixel, a blue subpixel, and a green subpixel when the sensing time reducing system according to one or more example embodiments performs sensing driving of the red subpixel, the white subpixel, the blue subpixel, and the green subpixel using the differentiated data overshooting-based data driving.
Figure 16:
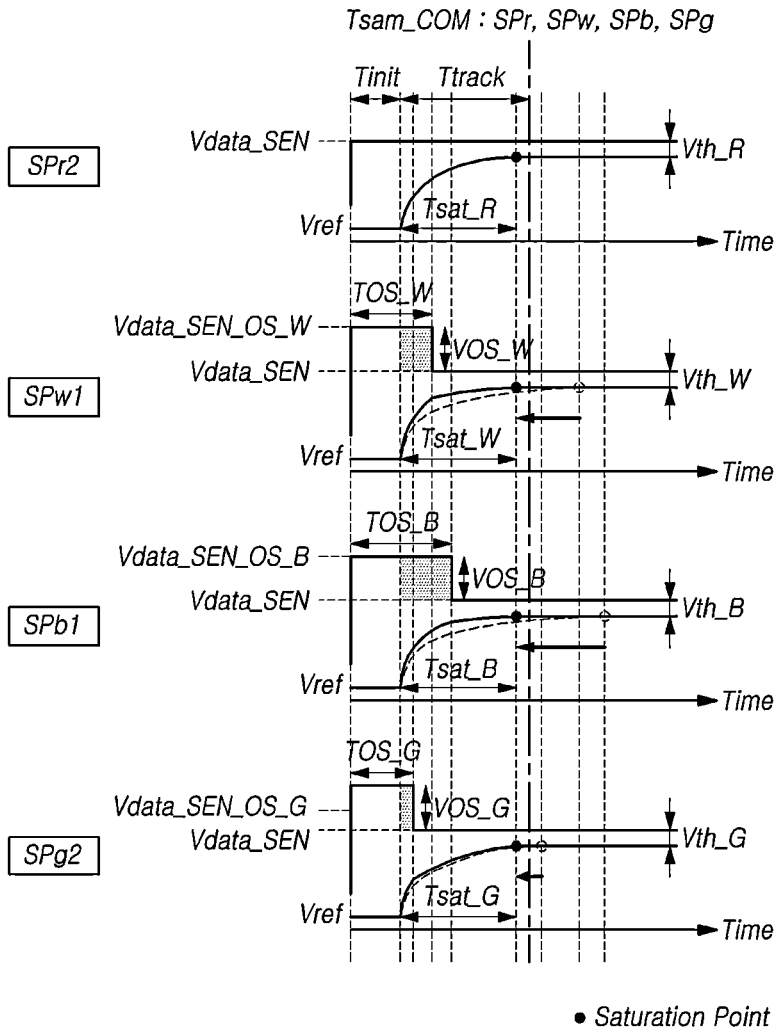

FIGS. 15 and 16 are graphs illustrating sensing driving waveforms for a red subpixel SPr, a white subpixel SPw1, a blue subpixel SPb1, and a green subpixel SPg2 when the sensing time reducing system according to one or more example embodiments performs sensing driving of the red subpixel SPr, the white subpixel SPw1, the blue subpixel SPb1, and the green subpixel SPg2 using the differentiated data overshooting-based data driving.

Here, the illustration is based on Case 3 in FIG. 10A. According to Case 3, the size Sr of the driving transistor DRT included in the red subpixel SPr may be the largest, the size Sg of the driving transistor DRT included in the green subpixel SPg2 may be the second largest, the size Sw of the driving transistor DRT included in the white subpixel SPw1 may be the third largest, and the size Sb of the driving transistor DRT included in the blue subpixel SPb1 may be the smallest.

According to Case 3, when the sensing driving is performed without using the data overshooting-based data driving, the saturation time Tsat_R for the red subpixel SPr may be the shortest, the saturation time Tsat_G for the green subpixel SPg2 may be the second shortest, the saturation time Tsat_W for the white subpixel SPw1 may be the third shortest (or the second longest), and the saturation time Tsat_B for the blue subpixel SPb1 may be the longest.

When the display device 100 according to one or more example embodiments reduces the sensing time using the differentiated data overshooting, the data overshooting-based data driving is not performed in the sensing driving of the red subpixel SPr. The differentiated data overshooting-based data driving may be performed for the green subpixel SPg2, the white subpixel SPw1, and the blue subpixel SPb1.

The differentiated data overshooting uses a data overshooting method in which the overshooting voltage or the overshooting length may be different.

During the tracking time Ttrack, the data signal Vdata transferred to the blue subpixel SPb1 may include the overshooting section having the voltage value Vdata_SEN_OS_B higher than the reference driving voltage value Vdata_SEN and the reference signal section having the reference driving voltage value Vdata_SEN.

During the tracking time Ttrack, the data signal Vdata transferred to the white subpixel SPw1 may include the overshooting section having the voltage value Vdata_SEN_OS_W higher than the reference driving voltage value Vdata_SEN and the reference signal section having the reference driving voltage value Vdata_SEN.

During the tracking time Ttrack, the data signal Vdata transferred in the saturation time Tsat_G for the green subpixel SPg2 may include the overshooting section having the voltage value Vdata_SEN_OS_G higher than the reference driving voltage value Vdata_SEN and the reference signal section having the reference driving voltage value Vdata_SEN.

Referring to FIG. 15, when the differentiated data overshooting is performed by overshooting voltage control, the overshooting voltage VOS_B may be the highest in the overshooting section of the data signal Vdata transferred to the blue subpixel SPb1. In the overshooting section of the data signal Vdata transferred to the white subpixel SPw1, the overshooting voltage VOS_W may be the second highest. In the overshooting section of the data signal Vdata transferred to the green subpixel SPg2, the overshooting voltage VOS_G may be the third highest.

Referring to FIG. 15, when the differentiated data overshooting is performed by the overshooting voltage control, all of the overshooting length TOS_B of the overshooting section of the data signal Vdata transferred to the blue subpixel SPb1, the overshooting length TOS_W of the overshooting section of the data signal Vdata transferred to the white subpixel SPw1, and the overshooting length TOS_G of the overshooting section of the data signal Vdata transferred to the green subpixel SPg2 may be the same, or some of the overshooting lengths TOS_B, TOS_W, and TOS_G may be different.

Referring to FIG. 16, when the differentiated data overshooting is performed by the overshooting length control, the overshooting length TOS_B may be the longest in the overshooting section of the data signal Vdata transferred to the blue subpixel SPb1. In the overshooting section of the data signal Vdata transferred to the white subpixel SPw1, the overshooting length TOS_W may be the second longest. In the overshooting section of the data signal Vdata transferred to the green subpixel SPg2, the overshooting length TOS_G may be the third longest.

Referring to FIG. 16, when the differentiated data overshooting is performed by the overshooting length control, all of the overshooting voltage VOS_B of the overshooting section of the data signal Vdata transferred to the blue subpixel SPb1, the overshooting voltage VOS_W of the overshooting section of the data signal Vdata transferred to the white subpixel SPw1, and the overshooting voltage VOS_G of the overshooting section of the data signal Vdata transferred to the green subpixel SPg2 may be the same, or some of the overshooting voltages VOS_B, VOS_W, and VOS_G may be different.

Referring to FIGS. 15 and 16, as the sensing driving is performed by the differentiated overshooting-based data driving by at least one of the overshooting voltage control and the overshooting length control, the decrease in the saturation time Tsat_B for the blue subpixel SPb1 may be the largest. The decrease in the saturation time Tsat_W for the white subpixel SPw1 may be the second largest. In addition, the decrease in the saturation time Tsat_G for the green subpixel SPg2 may be the third largest.

Thus, the saturation time Tsat_B for the blue subpixel SPb1, the saturation time Tsat_W for the white subpixel SPw1, and the saturation time Tsat_G for the green subpixel SPg2 may be the same as or within a predetermined range from the saturation time Tsat_R for the red subpixel SPr.

Thus, as illustrated in FIGS. 15 and 16, at or immediately after a point in time at which all of the saturation time Tsat_R for the red subpixel SPr, the saturation time Tsat_B for the blue subpixel SPb1, the saturation time Tsat_W for the white subpixel SPw1, and the saturation time Tsat_G for the green subpixel SPg2 are completed, the common sampling timing Tsam_COM may be set to be significantly advanced.

Figure 17A:
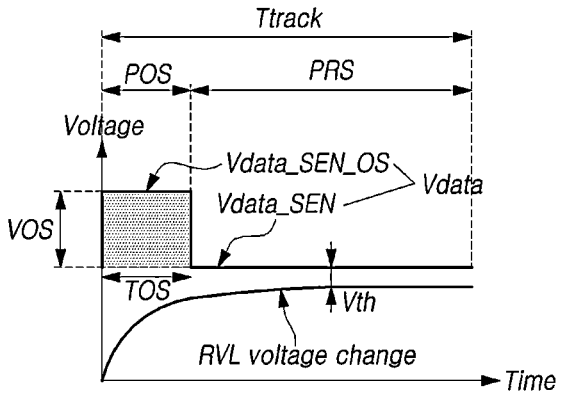
FIGS. 17A, 17B, and 17C are graphs illustrating a variety of waveforms of the data signal by the differentiated data overshooting according to one or more example embodiments.
Figure 17B:
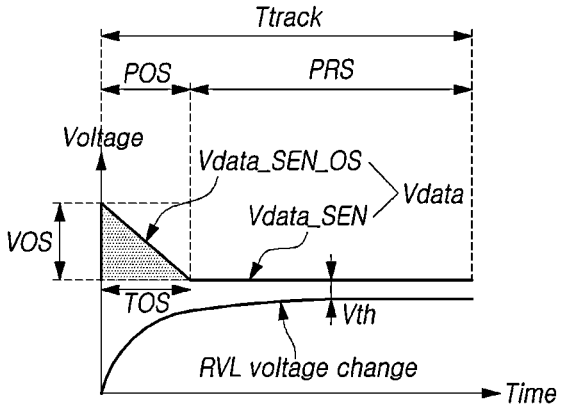
Figure 17C:
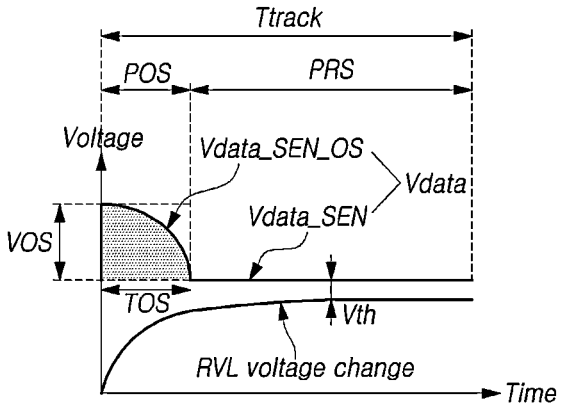

FIGS. 17A, 17B, and 17C are graphs illustrating a variety of waveforms of the data signal Vdata by the differentiated data overshooting according to one or more example embodiments.

Referring to FIGS. 17A, 17B, and 17C, during the tracking time Ttrack, the data signal Vdata may include an overshooting section POS in which the voltage value Vdata_SEN_OS of the data signal Vdata is higher than the reference driving voltage value Vdata_SEN and a reference signal section PRS in which the data signal Vdata has a reference driving voltage value Vdata_SEN.

As illustrated in FIG. 17A, the overshooting section POS in the data signal Vdata may be a constant voltage section. That is, the overshooting section POS in the data signal Vdata may be a signal section in which the voltage value Vdata_SEN_OS is constant and higher than the reference driving voltage value Vdata_SEN.

Alternatively, as illustrated in FIGS. 17B and 17C, the overshooting section POS in the data signal Vdata may be a voltage variable section. In this case, the overshooting section POS in the data signal Vdata may be a signal section in which the voltage value Vdata_SEN_OS higher than the reference driving voltage value Vdata_SEN changes to the reference driving voltage value Vdata_SEN.

When the overshooting section POS in the data signal Vdata is a voltage variable section, the pattern in which the higher voltage value Vdata_SEN_OS changes to the reference driving voltage value Vdata_SEN may be set to a variety of patterns.

Figure 18A:
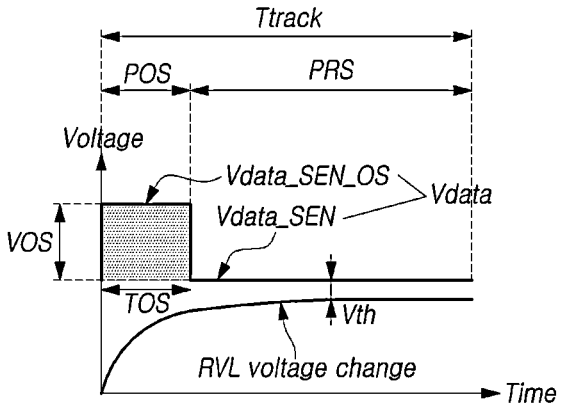
FIGS. 18A, 18B, and 18C are graphs illustrating data signals in which at least one of an overshooting voltage and an overshooting length is controlled by the differentiated data overshooting according to one or more example embodiments.
Figure 18B:
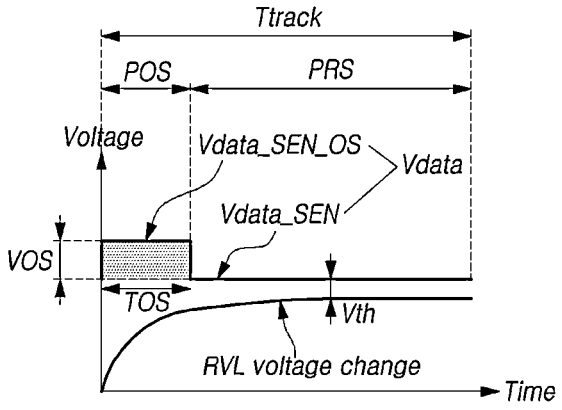
Figure 18C:
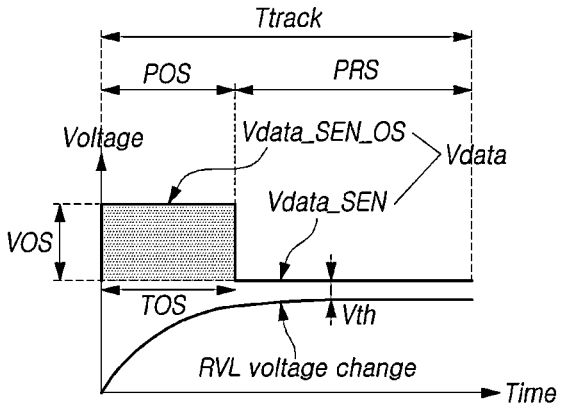

FIGS. 18A, 18B, and 18C are graphs illustrating data signals Vdata in which at least one of an overshooting voltage and an overshooting length is controlled by the differentiated data overshooting according to one or more example embodiments.

Referring to FIGS. 18A, 18B, and 18C, when the overshooting section POS in the data signal Vdata is a constant voltage section as in FIG. 17A, at least one of the overshooting voltage VOS and the overshooting length TOS of the overshooting section POS in the data signal Vdata may be controlled.

As illustrated in FIGS. 18A and 18B, the overshooting voltage VOS of the overshooting section POS in the data signal Vdata may be differently controlled.

In the case of FIG. 18C compared to FIGS. 18A and 18B, the overshooting length TOS of the overshooting section POS in the data signal Vdata may be controlled to increase.

According to the embodiments as set forth above, the display device 100 and the driver circuit can reduce sensing times by performing the sensing driving by the data overshooting-based data driving.

According to one or more example embodiments, the display device 100 and the driver circuit can synchronize sensing times for subpixels having different structural features while maintaining sensing accuracy for the subpixels by performing the sensing driving by the differentiated data overshooting-based data driving.

According to one or more example embodiments, the display device 100 and the driver circuit have a sensing time reduction function applicable to a double-rate driving environment.

The above description has been presented to enable any person skilled in the art to make and use the present invention, and has been provided in the context of one or more particular applications and their requirements. Various modifications, additions and substitutions to the described embodiments will be readily apparent to those skilled in the art, and the general principles defined herein may be applied to other embodiments and applications without departing from the spirit and scope of the present invention. The above description and the accompanying drawings provide one or more examples of the present invention for illustrative purposes only. That is, the disclosed embodiments are intended to illustrate one or more examples of the present invention. Thus, the scope of the present invention is not limited to the embodiments shown, but is to be accorded the widest scope consistent with the claims and their equivalents. The scope of protection of the present invention should be construed based on the following claims, and all technical features within the scope of equivalents thereof should be construed as being included within the scope of the present invention.

What is claimed is:

1. A display device comprising:

a display panel comprising a plurality of subpixels, a plurality of data lines, and a plurality of reference voltage lines; and a driver circuit having a configuration for driving the plurality of data lines, wherein:

the plurality of subpixels comprise a first subpixel connected to a first data line among the plurality of data lines and a first reference voltage line among the plurality of reference voltage lines;

a driving time of the first subpixel comprises a first initialization time in which a reference voltage is applied to the first reference voltage line and a first tracking time in which a voltage of the first reference voltage line increases from the reference voltage;

during the first tracking time, a first data signal transferred to the first subpixel through the first data line is changed from a first voltage value to a reference driving voltage value, and the first voltage value is higher than the reference driving voltage value;

the plurality of subpixels comprise a second subpixel connected to a second data line among the plurality of data lines and a second reference voltage line among the plurality of reference voltage lines;

a driving time of the second subpixel comprises a second initialization time in which the reference voltage is applied to the second reference voltage line and a second tracking time in which a voltage of the second reference voltage line increases from the reference voltage; and during the second tracking time, a second data signal transferred to the second subpixel through the second data line maintains the reference driving voltage value or is changed from a second voltage value to the reference driving voltage value, the second voltage value being higher than the reference driving voltage value and lower than the first voltage value.

2. The display device of claim 1, wherein the driver circuit comprises:

an analog-to-digital converter configured to output a voltage of the first reference voltage line or the second reference voltage line to a sensing value corresponding to a digital value;

a first sampling switch configured to connect the analog-to-digital converter and the first reference voltage line; and a second sampling switch configured to connect the analog-to-digital converter and the second reference voltage line, wherein, when the first sampling switch is turned on, the voltage of the first reference voltage line is in a saturated state, and when the second sampling switch is turned on, the voltage of the second reference voltage line is in a saturated state.

3. The display device of claim 2, wherein the first sampling switch and the second sampling switch are configured to be simultaneously turned on.

4. The display device of claim 1, wherein:

each of the first subpixel and the second subpixel comprises an emitting device and a driving transistor configured to supply current to the emitting device; and a size of the driving transistor of the first subpixel is smaller than a size of the driving transistor of the second subpixel.

5. The display device of claim 1, wherein:

each of the first subpixel and the second subpixel comprises an emitting device and a driving transistor configured to supply current to the emitting device; and a first time when the first voltage value is changed to the reference driving voltage value during the first tracking time is longer than a second time when the second voltage value is changed to the reference driving voltage value during the second tracking time.

6. The display device of claim 1, wherein the first subpixel is configured to emit light having a first color, and the second subpixel is configured to emit light having a second color different from the first color.

7. The display device of claim 6, wherein the driving time of the first subpixel and the driving time of the second subpixel overlap in time.

8. The display device of claim 6, wherein the driving time of the first subpixel and the driving time of the second subpixel do not overlap in time.

9. The display device of claim 1, wherein:

the plurality of subpixels comprise a third subpixel and a fourth subpixel disposed on a same subpixel line as the first subpixel and the second subpixel;

the third subpixel is connected to a third data line among the plurality of data lines, the third subpixel and the second subpixel are connected to the second reference voltage line, the fourth subpixel is connected to a fourth data line among the plurality of data lines, and the fourth subpixel and the first subpixel are connected to the first reference voltage line; and each of the first subpixel and the third subpixel is a subpixel configured to emit light having a first color, and each of the second subpixel and the fourth subpixel is a subpixel configured to emit light having a second color different from the first color.

10. The display device of claim 9, wherein:

the driving time of the first subpixel and the driving time of the second subpixel overlap in time, and the driving time of the third subpixel and the driving time of the fourth subpixel overlap in time; and the driving time of the first subpixel and the driving time of the second subpixel do not overlap in time the driving time of the third subpixel and the driving time of the fourth subpixel.

11. The display device of claim 9, wherein the driver circuit comprises a first data channel terminal connected to both the first data line and the third data line and a second data channel terminal connected to both the second data line and the fourth data line.

12. The display device of claim 1, wherein, during the first tracking time, the first data signal comprises an overshooting section in which a voltage value of the first data signal is higher than the reference driving voltage value and a reference signal section in which the first data signal has the reference driving voltage value, the overshooting section being a constant voltage section in which the first voltage value is constant.

13. The display device of claim 1, wherein, during the first tracking time, the first data signal comprises an overshooting section in which a voltage value of the first data signal is higher than the reference driving voltage value and a reference signal section in which the first data signal has the reference driving voltage value, the overshooting section changing from the first voltage value to the reference driving voltage value.

14. A driver circuit comprising:

a first data channel terminal to which a first data line is connected;

a data signal provider configured to output a first data signal to the first data channel terminal;

a first sensing channel terminal connected to a first reference voltage line;

a second data channel terminal to which a second data line is connected; and a second sensing channel terminal connected to a second reference voltage line, wherein:

the first data line and the first reference voltage line are connected to a first subpixel;

a driving time of the first subpixel comprises a first initialization time in which a reference voltage is applied to the first reference voltage line and a first tracking time in which a voltage of the first reference voltage line increases from the reference voltage;

during the first tracking time, the first data signal transferred to the first subpixel is changed from a first voltage value to a reference driving voltage value, and the first voltage value is higher than the reference driving voltage value;

the second data line and the second reference voltage line are connected to a second subpixel;

the data signal provider is configured to output a second data signal to the second data channel terminal;

a driving time of the second subpixel comprises a second initialization time in which the reference voltage is applied to the second reference voltage line and a second tracking time in which a voltage of the second reference voltage line increases from the reference voltage; and during the second tracking time, the second data signal output through the second data channel terminal maintains the reference driving voltage value or is changed from a second voltage value to the reference driving voltage value, the second voltage value being higher than the reference driving voltage value and lower than the first voltage value.

15. The driver circuit of claim 14, wherein a size of a driving transistor in the first subpixel is smaller than a size of a driving transistor in the second subpixel.

16. The driver circuit of claim 14, wherein:

the first data channel terminal is connected to both the first data line and a third data line, the third data line is connected to a third subpixel configured to emit light having a first color which is the same as a color of light being emitted from the first subpixel, and the third subpixel and the second subpixel are connected in common to the second reference voltage line; and the second data channel terminal is connected to both the second data line and a fourth data line, the fourth data line is connected to a fourth subpixel configured to emit light having a second color which is the same as a color of light being emitted from the second subpixel, and the fourth subpixel and first second subpixel are connected in common to the first reference voltage line.

* * * * *